US010981683B2

(12) United States Patent
Iwasa et al.

(10) Patent No.: US 10,981,683 B2
(45) Date of Patent: Apr. 20, 2021

(54) BOXING APPARATUS

(71) Applicant: ISHIDA CO., LTD., Kyoto (JP)

(72) Inventors: Tatsuya Iwasa, Ritto (JP); Yuji Yokota, Ritto (JP); Takeshi Noguchi, Ritto (JP); Tatsuya Arimatsu, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 160 days.

(21) Appl. No.: 16/064,456

(22) PCT Filed: Dec. 25, 2015

(86) PCT No.: PCT/JP2015/086246
§ 371 (c)(1),
(2) Date: Jun. 21, 2018

(87) PCT Pub. No.: WO2017/109941
PCT Pub. Date: Jun. 29, 2017

(65) Prior Publication Data

US 2018/0370668 A1 Dec. 27, 2018

(51) Int. Cl.
*B65B 43/60* (2006.01)
*B65B 5/06* (2006.01)
(Continued)

(52) U.S. Cl.
CPC ..... *B65B 43/60* (2013.01); *B65B 5/06* (2013.01); *B65B 5/061* (2013.01); *B65B 5/10* (2013.01);
(Continued)

(58) Field of Classification Search
CPC ..... B65B 43/60; B65B 43/59; B65B 43/26; B65B 43/54; B65B 43/265; B65B 43/58;
(Continued)

(56) References Cited

U.S. PATENT DOCUMENTS 3,434,603 A * 3/1969 Horman ..... B65B 5/106 414/792.3
4,329,831 A * 5/1982 Warkentin ..... B65B 25/046 53/240
(Continued)

FOREIGN PATENT DOCUMENTS

JP S59-78201 U 5/1984
JP H02-109804 A 4/1990
(Continued)

OTHER PUBLICATIONS

The Search Report from the corresponding International Patent Application No. PCT/JP2015/086246 dated Mar. 22, 2016.
(Continued)

*Primary Examiner* — Thanh K Truong
*Assistant Examiner* — Katie L Gerth
(74) *Attorney, Agent, or Firm* — Shinjyu Global IP

(57) ABSTRACT

Provided is a boxing apparatus that pushes a plurality of articles into a box, whose opening may face sideways, from the side and, thereafter, change the posture of the box by rotating the box so that the opening faces upward, wherein the possibility that the articles fly out of the box when changing the posture is reduced and the posture of the box can be changed in a short period of time. The boxing apparatus may include a push-in mechanism, a holding and posture changing mechanism, and a guide/holding member.

8 Claims, 10 Drawing Sheets

(51) Int. Cl.

| | |
|---|---|
| ***B65B 43/59*** | (2006.01) |
| ***B65B 43/26*** | (2006.01) |
| ***B65B 35/10*** | (2006.01) |
| ***B65B 5/10*** | (2006.01) |
| ***B65B 43/54*** | (2006.01) |
| ***B65B 43/58*** | (2006.01) |

(52) U.S. Cl.
CPC ..... *B65B 5/106* (2013.01); *B65B 5/108* (2013.01); *B65B 35/10* (2013.01); *B65B 43/26* (2013.01); *B65B 43/265* (2013.01); *B65B 43/54* (2013.01); *B65B 43/58* (2013.01); *B65B 43/59* (2013.01)

(58) Field of Classification Search
CPC ..... B65B 5/06; B65B 5/10; B65B 10/061; B65B 5/106; B65B 5/108; B65B 35/10
See application file for complete search history.

(56) References Cited

U.S. PATENT DOCUMENTS

| | | | | |
|---|---|---|---|---|
| 5,515,664 | A * | 5/1996 | Tanaka | B65B 5/06 53/243 |
| 5,732,536 | A * | 3/1998 | Lin | B65B 5/106 53/245 |
| 10,202,212 | B2 * | 2/2019 | Nagata | B65B 5/06 |
| 2002/0170278 | A1 * | 11/2002 | Hofmann | B65G 57/11 53/540 |
| 2006/0070353 | A1 * | 4/2006 | Van Dam | B65B 5/108 53/447 |
| 2006/0180435 | A1 * | 8/2006 | Swider | B65H 31/22 198/463.3 |
| 2011/0005174 | A1 * | 1/2011 | Prahm | B65B 5/061 53/473 |
| 2011/0167771 | A1 * | 7/2011 | Till | B65B 5/061 53/475 |
| 2013/0283731 | A1 * | 10/2013 | Komp | B65B 5/06 53/268 |
| 2015/0013277 | A1 * | 1/2015 | Brandhorst | B65B 5/105 53/475 |
| 2015/0203228 | A1 * | 7/2015 | Johnson | B65B 39/12 53/249 |
| 2015/0324893 | A1 * | 11/2015 | Langen | B65B 43/145 705/26.81 |

FOREIGN PATENT DOCUMENTS

| | | | |
|---|---|---|---|
| JP | H04-16101 | U | 2/1992 |
| JP | H07-10289 | A | 1/1995 |
| JP | 2008-302962 | A | 12/2008 |
| JP | 2014-061904 | A | 4/2014 |
| JP | 2015-514644 | A | 5/2015 |

OTHER PUBLICATIONS

The Preliminary Report on Patentability (with Written Opinion) from the corresponding International Patent Application No. PCT/JP2015/086246 dated Jun. 26, 2018.
The Office Action from the corresponding Japanese Patent Application No. 2017-557622 dated Feb. 4, 2020.

* cited by examiner

BOXING APPARATUS

PRIORITY

This is a National Stage Application under 35 U.S.C. § 365 of International Application PCT/JP2015/086246, with an international filing date of Dec. 25, 2015. The entire disclosure of International Application PCT/JP2015/086246 is hereby incorporated herein by reference.

TECHNICAL FIELD

Certain implementations may relate to a boxing apparatus, and more particularly to a boxing apparatus that pushes a plurality of articles into a box, whose opening faces sideways, from the side, and, thereafter, changes the posture of the box by rotating the box so that the opening faces upward.

BACKGROUND

In the related art, there are boxing apparatuses that push a plurality of articles into a box, whose opening faces sideways, from the side and, thereafter, change the posture of the box by rotating the box so that the opening faces upward.

SUMMARY

When a box is rotated at a relatively slow speed or the rotation speed of the box is temporarily reduced. As such, there is room for improvement for enhancing the processing capability of the apparatus.

An object of certain implementations is to provide a boxing apparatus that pushes a plurality of articles into a box, whose opening faces sideways, from the side and, thereafter, changes the posture of the box by rotating the box so that the opening faces upward, and that has high reliability and efficiency by reducing the possibility that the articles fly out of the box when changing the posture while enabling to change the posture of the box in a short period of time.

A boxing apparatus according to a first aspect of an implementation includes a push-in mechanism, a holding and posture changing mechanism, and a holding member. The push-in mechanism pushes a plurality of articles into a box, whose opening faces sideways, from the side. The holding and posture changing mechanism holds the box, whose opening faces sideways, and changes the posture of the box, after the articles have been pushed into the box by the push-in mechanism, by rotating the box whose opening faces sideways, such that the opening faces upward. The holding member holds at least a portion of the articles stored in the box at a time of a posture change operation of the box by the holding and posture changing mechanism.

With the boxing apparatus according to the first aspect of an implementation, the holding member holds at least a portion of the articles stored in the box when the box is rotated to change the posture of the box. As such, the possibility can be reduced that the articles fly out through the opening due to the inertial forces, even when the rotation speed of the box is large. As a result, a highly reliable and efficient boxing apparatus can be achieved in which the possibility that the articles fly out of the box at the time of the posture change operation by the holding and posture changing mechanism is reduced, and the posture of the box can be changed in a short period of time.

Furthermore, in this case, the holding member holds at least a portion of the articles stored in the box when the posture of the box is changed. As such, it is possible to decrease the probability that the storage state of the articles in the box become cluttered as a result of the articles moving and/or the posture of the articles changing in the box.

A boxing apparatus according to a second aspect of an implementation is the boxing apparatus according to the first aspect, wherein the holding member holds a back side in a movement direction of the articles stored in the box at the time of the posture change operation of the box by the holding and posture changing mechanism.

With the boxing apparatus according to the second aspect of an implementation, the holding member holds the back side in the movement direction of the articles. As a result, the possibility can be reduced that the articles fly out through the opening of the box due to inertial forces.

A boxing apparatus according to a third aspect of an implementation is the boxing apparatus according to the first or second aspect, wherein the holding member holds at least the articles disposed in an uppermost layer in the box, whose opening faces sideways, at the time of the posture change operation of the box by the holding and posture changing mechanism.

With the boxing apparatus according to the third aspect of an implementation, the possibility can be reduced that the articles in the uppermost layer, which are most prone to inertial forces, fly out through the opening when changing the posture of the box by moving the upper edge of the box, whose opening faces sideways, downward.

A boxing apparatus according to a fourth aspect of an implementation is the boxing apparatus according to any one of the first to third aspects, wherein the holding member functions as a guide member that enters into the box through the opening and uses an upper guide face thereof to guide the movement of the articles when the push-in mechanism pushes the articles into the box whose opening faces sideways.

With the boxing apparatus according to the fourth aspect of an implementation, the guide member that guides the movement of the articles when pushing the articles into the box also functions as the holding member, thereby eliminating the need for a separate, dedicated holding member and making it possible to lessen the increases in apparatus costs.

A boxing apparatus according to a fifth aspect of an implementation is the boxing apparatus according to any one of the first to fourth aspects, wherein the holding member holds at least a portion of the articles stored in the box and further pushes the articles into the box at the time of the posture change operation of the box by the holding and posture changing mechanism.

With the boxing apparatus according to the fifth aspect of an implementation, the holding member does not only hold the articles, but also pushes the articles into the box, thereby making it remarkably easier to reduce the possibility that the articles fly out through the opening.

A boxing apparatus according to a sixth aspect of an implementation is the boxing apparatus according to any one of the first to fifth aspects, wherein the holding member holds at least a portion of the articles stored in the box during at least an initial stage of the posture change operation of the box by the holding and posture changing mechanism.

With the boxing apparatus according to the sixth aspect of an implementation, the possibility that the articles fly out can be reduced by the holding member during the initial stage of the posture change operation of the box, at which gravity is less likely to act as a force to suppress the articles from flying out through the opening.

A boxing apparatus according to a seventh aspect of an implementation is the boxing apparatus according to any one of the first to sixth aspects, wherein the holding member holds the articles stored in the box while moving in a first direction. The magnitude of the movement speed of the holding member when holding the articles stored in the box is larger than the magnitude of the first direction component of the movement speed of the articles to be held by the holding member.

With the boxing apparatus according to the seventh aspect of an implementation, the holding member moves faster than the articles to be held by the holding member. As a result, it is more likely that the articles will be held reliably by the holding member, thereby making it easier to reduce the possibility that the articles fly out through the opening.

A boxing apparatus according to an eighth aspect of an implementation is the boxing apparatus according to any one of the first to seventh aspects, wherein the articles are bag products made from a flexible packing material.

With the boxing apparatus according to the eighth aspect of an implementation, the articles are bag products made from a flexible packing material and the shape thereof easily changes. As such, space is more likely to form between the bag products and phenomena such as a portion of the bag product protruding through the opening of the box are more likely to occur. However, the holding member can easily reduce the possibility that the articles fly out through the opening even when the articles to be boxed are bag products.

When the boxing apparatus of an implementation rotates the box to change the posture of the box, the holding member holds at least a portion of the articles stored in the box. As such, the possibility can be reduced that the articles fly out of the box thorough the opening due to inertial forces even when the rotation speed of the box is large. As a result, a highly reliable and efficient boxing apparatus can be achieved in which the possibility that the articles fly out of the box at the time of the posture change operation by the holding and posture changing mechanism is reduced, and the posture of the box can be changed in a short period of time.

DETAILED DESCRIPTION

Next, certain implementations will be described with reference to the drawings. Note that the following embodiments are merely examples of the present invention and should not be construed as limiting the technical scope of the present invention. Moreover, various modifications can be made without departing from the spirit and scope of the present invention.

(1) Overview

Figure 1:
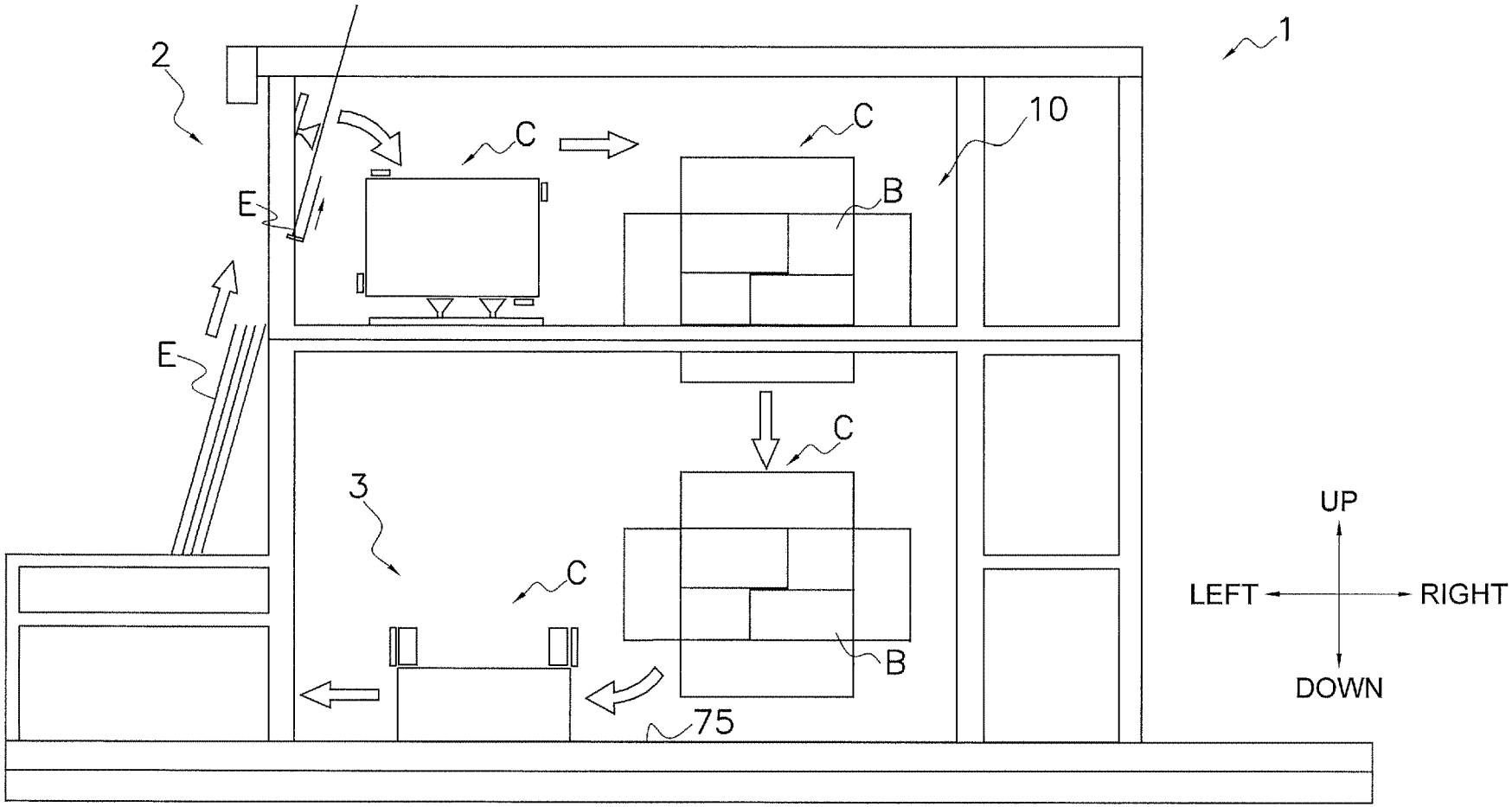
FIG. 1 is a schematic rear view of a box making and boxing system including a boxing apparatus according to an implementation, wherein the box making and boxing system is viewed from the back side (a bottom lid side of a cardboard box) of the boxing apparatus.

FIG. 1 is a schematic front view of a box making and boxing system 1 including a boxing apparatus 10 according to an implementation.

Hereinafter, the box making and boxing system 1 will be briefly described. Note that, in the following description, terms such as "up-down", "left-right", and "front-back" are used to describe positions and orientations. Unless otherwise noted, these terms correspond to "up-down", "left-right", "front-back", and the like indicated by the arrows depicted in the drawings.

The box making and boxing system 1 includes a box making apparatus 2, a boxing apparatus 10, and a box closing apparatus 3.

The box making apparatus 2 opens a cardboard sheet E (a cardboard box C in a folded state) stocked standing vertically (opening a box) and closes a bottom lid B of the cardboard box C to make the cardboard box C, in which only one side (only the top lid side) is open. The cardboard box C made by the box making apparatus 2 is transported to the boxing apparatus 10 by a conveyor (not illustrated in the drawings).

The cardboard box C, whose opening faces sideways, is supplied from the box making apparatus 2 to the boxing apparatus 10 by the conveyor (not illustrated in the drawings). The cardboard box C, in which the bottom lid B is arranged on the back side and the front side is open (the opening faces forward), is supplied from the box making apparatus 2 to the boxing apparatus 10 by the conveyor.

Figure 2:
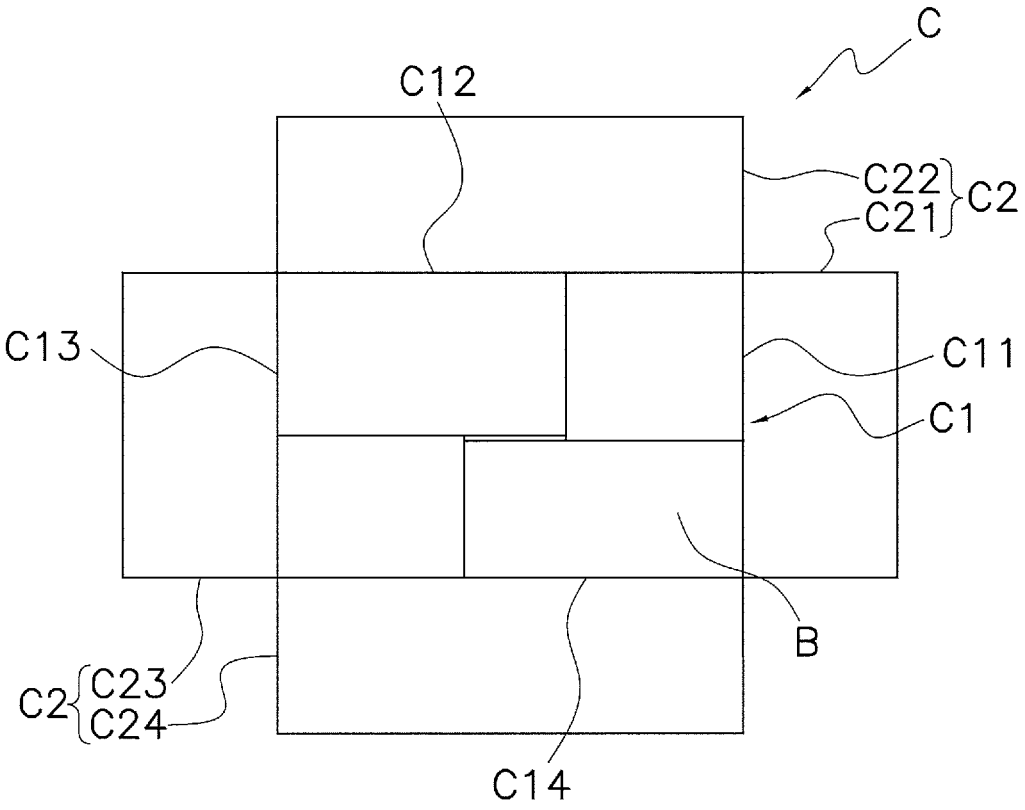
FIG. 2 illustrates a cardboard box used in the boxing apparatus depicted in FIG. 1 to package articles, viewed from the bottom lid side.
Figure 4:
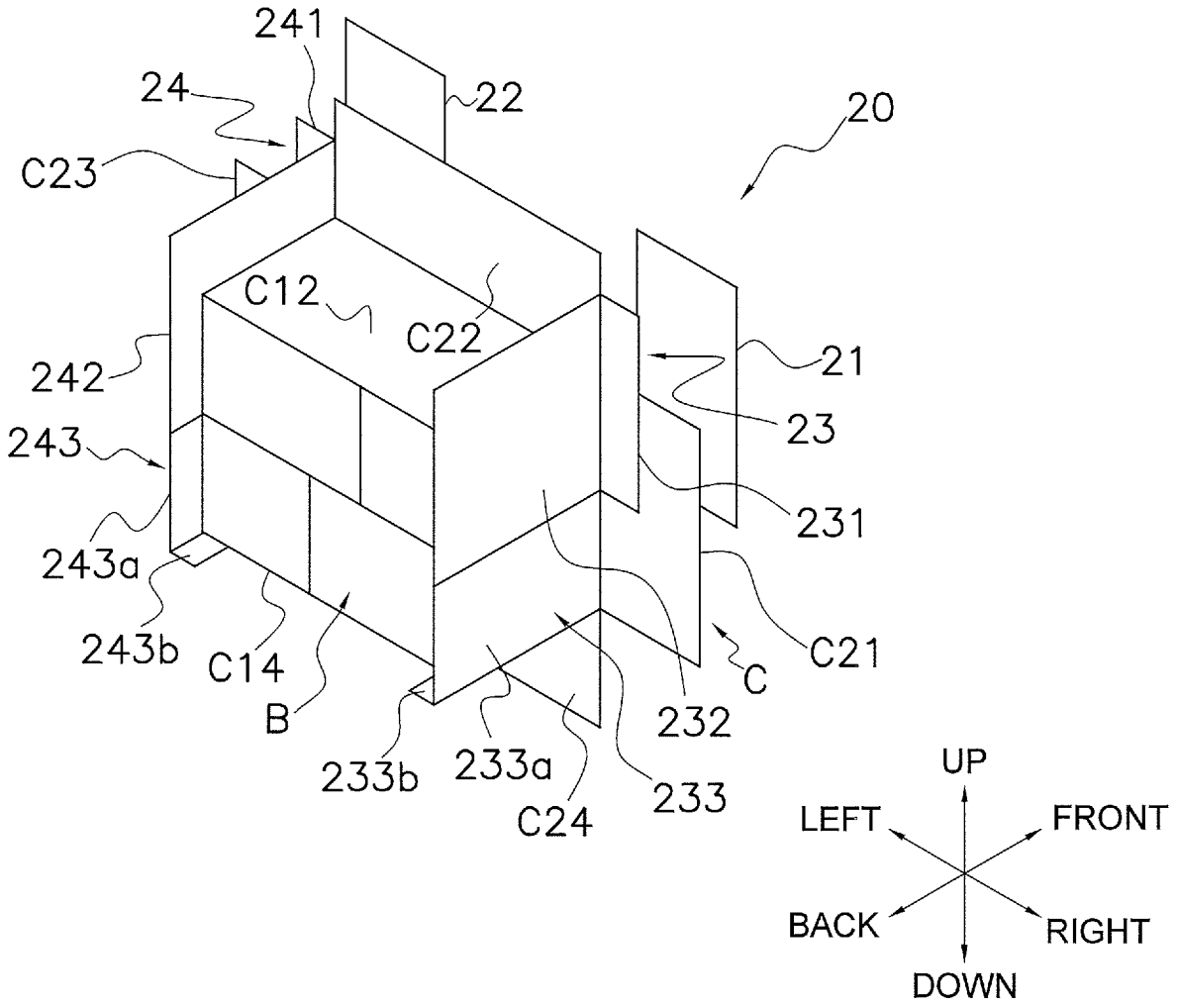
FIG. 4 is a schematic perspective view explaining a dropping mechanism of the boxing apparatus depicted in FIG. 1.

Note that, as illustrated in FIG. 2, the cardboard box C used in the box making and boxing system 1 has a side face portion C1 formed into a ring shape (rectangular ring shape) with four side faces C11 to C14, and a total of eight flat flaps C2 extending from the fronts and backs of the four side faces C11 to C14. At the point in time at which the cardboard box C is supplied to the boxing apparatus 10, the box making apparatus 2 has closed the flaps C2 on the bottom lid side (back side) and formed the bottom lid B as illustrated in FIGS. 2 and 4. The flaps C21 to C24 (C2) on the top lid side (the front side) are in an outwardly unfolded state. As illustrated in FIG. 2, the cardboard box C is supplied to the boxing apparatus 10 with the side face C14 facing downward.

The boxing apparatus 10 mainly includes a dropping mechanism 20, a push-in mechanism 40, a holding and posture changing mechanism 50, a guide/holding mechanism 100, a spill-prevention mechanism 90, an article transportation unit 70, a conveyor 75, and a control device 80 (see FIGS. 3, 5, 7A, and 7G).

The dropping mechanism 20 drops the cardboard box C, supplied from the box making apparatus 2 by the conveyor, downward in a state in which the side face C14 faces downward and the front side is open, and thereby changes the height position of the cardboard box C.

The push-in mechanism 40 pushes articles A (objects to be packaged) transported by the article transportation unit 70 from the side (from the front side) into the cardboard box C, which was dropped by the dropping mechanism 20 and whose opening faces sideways.

In this embodiment, the articles A are bag products made from a flexible packing material. The phrase, "bag products made from a flexible packing material" refers to bags made from a material with abundant flexibility in which objects to be packaged are accommodated. Examples of materials with abundant flexibility include paper, plastic film, aluminum foil, and fabric. Specific examples of the articles A are bags made from plastic film which accommodates snack food.

Note that the articles A are not limited to bag products made from a flexible packing material and, for example, the articles A may be box-shaped products (boxes in which objects to be packaged are accommodated) made from a material that does not deform or does not easily deform. Additionally, the articles A are not limited to containers in which objects to be packaged are accommodated.

In the present embodiment, when the push-in mechanism 40 performs the push-in operation of the articles A one time, the articles A, which are arranged side-by-side in a plurality of rows (e.g. two rows) in the front-back direction and a plurality of columns (e.g. six columns) in the left-right direction, are pushed into the cardboard box C. Moreover, in the present embodiment, the push-in mechanism 40 performs the push-in operation a plurality of times (e.g. two times) for one cardboard box C, thereby pushing a plurality of layers of the articles A into the cardboard box C whose opening faces sideways. Note that, the number of the articles A pushed into the cardboard box C when the push-in mechanism 40 performs the push-in operation of the articles A one time, and the number of times the push-in mechanism 40 performs the push-in operation for one cardboard box C are merely examples and the present invention should not be construed as being limited thereto. For example, a configuration is possible in which the push-in mechanism 40 performs the push-in operation for one cardboard box C only one time. In other words, a configuration is possible in which only one layer of the articles A is pushed into the cardboard box C whose opening faces sideways.

The holding and posture changing mechanism 50 holds the cardboard box C, whose opening faces sideways, when the push-in mechanism 40 pushes the articles A into the cardboard box C. Additionally, the holding and posture changing mechanism 50 adjusts a height position of the cardboard box C. Furthermore, after the push-in mechanism 40 has pushed the articles A into the cardboard box C, the holding and posture changing mechanism 50 rotates the cardboard box C, whose opening faces sideways and in which the articles A are stored, such that the opening faces upward, thereby changing the posture of the cardboard box C.

The guide/holding mechanism 100 guides the movement of the articles A when the push-in mechanism 40 pushes the articles A into the cardboard box C whose opening faces sideways. Additionally, the guide/holding mechanism 100 holds at least a portion of the articles A stored in the cardboard box C at the time of the posture change operation of the cardboard box C by the holding and posture changing mechanism 50.

The spill-prevention mechanism 90 reduces the possibility that the articles A spill from the opening when the holding and posture changing mechanism 50 moves vertically the cardboard box C, in which the front side is open and the articles A are stored.

The conveyor 75 transports the cardboard box C, which has been raised by the holding and posture changing mechanism 50 so that the opening faces upward, in the horizontal direction, and supplies the cardboard box C to the box closing apparatus 3.

The control device 80 controls the actions of the dropping mechanism 20, the push-in mechanism 40, the holding and posture changing mechanism 50, the guide/holding mechanism 100, the article transportation unit 70, the conveyor 75, and the like.

The dropping mechanism 20, the push-in mechanism 40, the holding and posture changing mechanism 50, the guide/holding mechanism 100, the spill-prevention mechanism 90, the article transportation unit 70, the conveyor 75, and the control device 80 of the boxing apparatus 10 will be described in detail later.

The box closing apparatus 3 closes the flaps C2 (the flaps C21 to C24) on the top lid side of the cardboard box C, whose opening faces upward and which was supplied by the conveyor 75, and forms the top lid. Then, the cardboard box C, in which the top lid has been closed by the box closing apparatus 3, is transported out of the box making and boxing system 1.

(2) Detailed Configuration of Boxing Apparatus

Next, detailed descriptions are given for the dropping mechanism 20, the push-in mechanism 40, the guide/holding mechanism 100, the holding and posture changing mechanism 50, the spill-prevention mechanism 90, the article transportation unit 70, the conveyor 75, and the control device 80 of the boxing apparatus 10.

Note that, in the following descriptions, terms such as "horizontal", "vertical", "parallel", "orthogonal", and "identical" are used. These terms include "horizontal", "vertical", "parallel", "orthogonal", and "identical" in the strict sense and also "horizontal", "vertical", "parallel", "orthogonal", and "identical" in the broad sense.

(2-1) Dropping Mechanism

The dropping mechanism 20 drops the cardboard box C, which was supplied from the box making apparatus 2 via the conveyor (not illustrated in the drawings) and whose opening faces forward, with the side face C14 facing downward, and changes the height position of the cardboard box C. The flap C22 extending from the side face C12 on the upper side, the flap C21 extending from the side face C11 on the right side, the flap C23 extending from the side face C13 on the left side, and the flap C24 extending from the side face C14 on the lower side are unfolded outwardly as illustrated in FIG. 4. That is, the dropping mechanism 20 changes the height position of the cardboard box C while the opening is not closed by the flaps C21 to C24. Additionally, the dropping mechanism 20 horizontally moves the dropped cardboard box C forward. Furthermore, the dropping mechanism 20 restricts movement of the cardboard box C in the horizontal direction when the articles A are being pushed into the cardboard box C. That is, the dropping mechanism 20 functions as a horizontal position adjusting mechanism for the cardboard box C.

Figure 3:
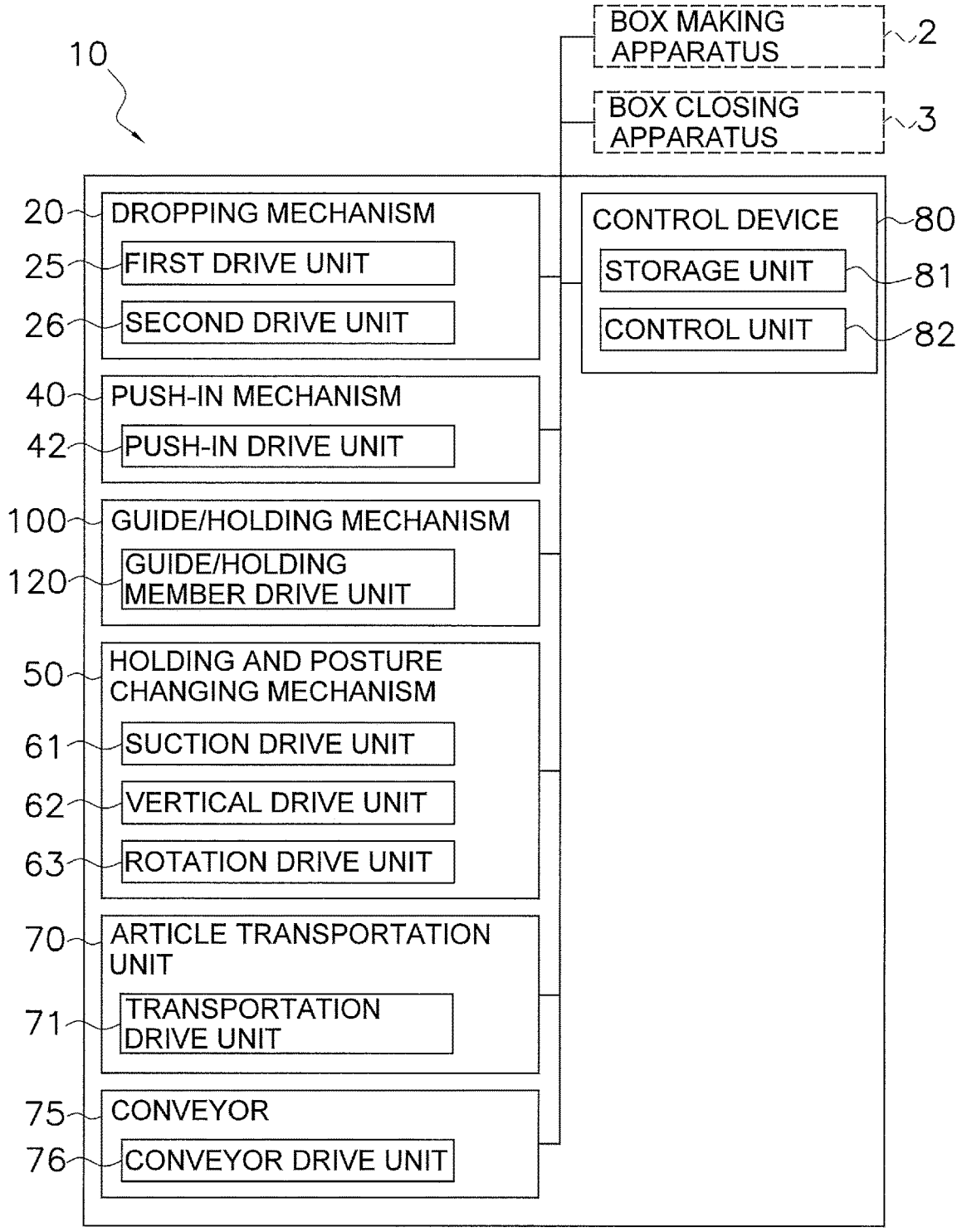
FIG. 3 is a block diagram of the boxing apparatus depicted in FIG. 1.

The dropping mechanism 20 includes first guide members 21 and 22 and second guide members 23 and 24 (see FIGS. 4 and 5), and a first drive unit 25 and a second drive unit 26 (see FIG. 3).

The first guide members 21 and 22 are flat members respectively disposed in front of the flaps C21 and C23 of the cardboard box C, dropped by the dropping mechanism 20, so as to face the flaps C21 and C23. The first guide member 21 also faces a portion of the flap C22 of the cardboard box C dropped by the dropping mechanism 20. The second guide members 23 and 24 are members respectively disposed behind the flaps C21 and C23 of the cardboard box C dropped by the dropping mechanism 20, and face the flaps C21 and C23.

The second guide member 23 includes a first flat plate 231, a second flat plate 232, and a movable hook 233. The first flat plate 231 faces the first guide member 21. The second flat plate 232 extends backward from the left edge of the first flat plate 231 and is orthogonal to the first flat plate 231.

The second guide member 24 includes a first flat plate 241, a second flat plate 242, and a movable hook 243. The first flat plate 241 faces the first guide member 22. The second flat plate 242 extends backward from the right edge of the first flat plate 241 and is orthogonal to the first flat plate 241.

When the cardboard box C is dropped, the flap C21 passes between the first guide member 21 and the first flat plate 231 of the second guide member 23, and the flap C23 passes between the first guide member 22 and the first flat plate 241 of the second guide member 24. The first guide member 21 and the first flat plate 231 of the second guide member 23 are disposed with an appropriate spacing therebetween, and restrict movement in the horizontal direction (particularly the front-back direction) of the flap C21 of the falling cardboard box C. The first guide member 22 and the first flat plate 241 of the second guide member 24 are disposed with an appropriate spacing therebetween, and restrict movement in the horizontal direction (particularly the front-back direction) of the flap C23 of the falling cardboard box C. The first guide members 21 and 22 and the second guide members 23 and 24 restrict movement of the flaps C21 and C23 of the cardboard box C that is falling, thereby guiding the falling of the cardboard box C such that the cardboard box C falls with a predetermined posture to a predetermined position.

Additionally, the first guide member 21 also faces the flap C22 of the cardboard box C that is falling and restricts movement of the flap C22 so that the flap C22 does not close (fold forward). The first guide member 21 also restricts movement of the flap C22 so that the flap C22 does not close after the cardboard box C has fallen.

After the cardboard box C has fallen, the second guide members 23 and 24 are driven forward by the first drive unit 25 to the vicinity of the first guide members 21 and 22, respectively. At this time, the first flat plate 231 of the second guide member 23 contacts the surface of the back side of the flap C21 and the first flat plate 241 of the second guide member 24 contacts the surface of the back side of the flap C21 and the surface of the back side of the flap C23, respectively, and the cardboard box C is moved forward (advanced) toward the first guide members 21 and 22. At the point in time at which the movement of the second guide members 23 and 24 by the first drive unit 25 is completed, when viewed planarly, the cardboard box C has been moved to an article push-in position (position where the articles A are pushed into the cardboard box C by the push-in mechanism 40 described later). Additionally, the holding and posture changing mechanism 50 (described later) adjusts the position in the height direction of the cardboard box C.

Moreover, at the point in time at which the movement of the second guide members 23 and 24 by the first drive unit 25 has completed, the flap C21 is sandwiched between the first guide member 21 and the first flat plate 231 of the second guide member 23, and the flap C23 is sandwiched between the first guide member 22 and the first flat plate 241 of the second guide member 24. As a result, when the articles A are pushed into the cardboard box C, movement in the horizontal direction of the flap C21 and the flap C23 is restricted. As the first guide members 21 and 22 and the second guide members 23 and 24 restrict movement in the horizontal direction of the flap C21 and the flap C23, the movement in the horizontal direction of the cardboard box C is restricted when the articles A are pushed into the cardboard box C.

Note that, as described later, the holding and posture changing mechanism 50 moves the cardboard box C in the up-down direction when boxing the articles A in the cardboard box C. As such, the first guide member 21 and the second guide member 23 are disposed with a spacing therebetween that is sufficient to allow the flap C21 of the cardboard box C to move freely in the vertical direction. Additionally, the first guide member 22 and the second guide member 24 are disposed with a spacing therebetween that is sufficient to allow the flap C23 of the cardboard box C to move freely in the vertical direction.

When the cardboard box C is dropped, the side face portion C1 of the cardboard box C passes between the second flat plate 232 of the second guide member 23 and the second flat plate 242 of the second guide member 24. The second flat plate 232 of the second guide member 23 faces the side face C11 of the cardboard box C that is falling. The second flat plate 242 of the second guide member 24 faces the side face C13 of the cardboard box C that is falling. The second flat plate 232 of the second guide member 23 and the second flat plate 242 of the second guide member 24 are disposed with an appropriate spacing therebetween that suits to the size of the side face portion C1 of the cardboard box C, and restrict movement in the horizontal direction (particularly the left-right direction) of the side face portion C1 of the cardboard box C that is falling. Additionally, after the cardboard box C has fallen as well, the second flat plate 232 of the second guide member 23 and the second flat plate 242 of the second guide member 24 restrict movement in the horizontal direction (particularly the left-right direction direction) of the side face portion C1 of the cardboard box C disposed therebetween.

Figure 5:
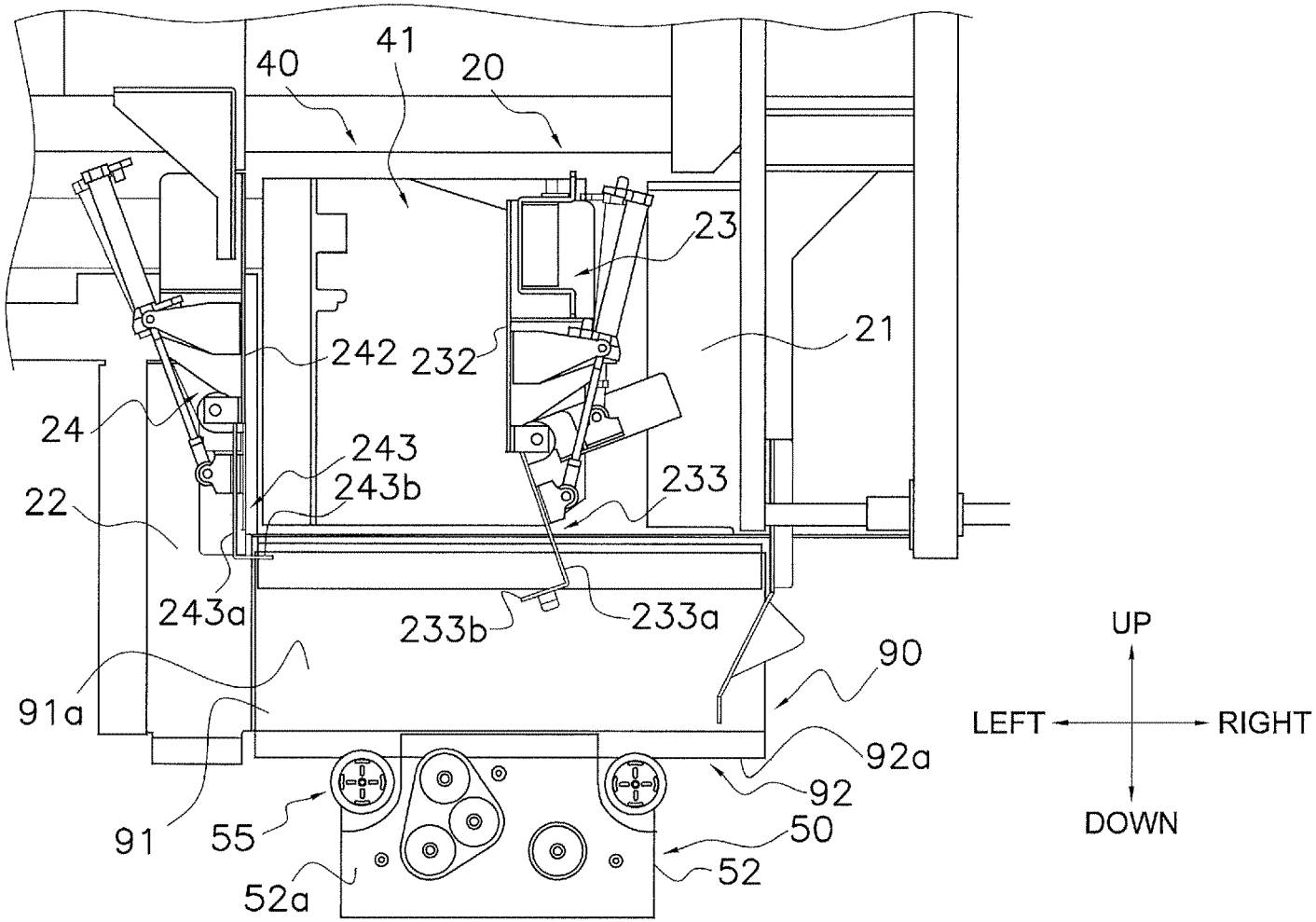
FIG. 5 is a back view of the surroundings of a holding and posture changing mechanism of the boxing apparatus depicted in FIG. 1, wherein the surroundings of the holding and posture changing mechanism are viewed from the back side, and a state is depicted in which an abutting surface of an abutting plate of the holding and posture changing mechanism faces backward.

As illustrated in FIGS. 4 and 5, the movable hooks 233 and 243 are respectively provided on the lower portions of the second guide members 23 and 24. The movable hook 233 is coupled to the lower edge of the second flat plate 232 of the second guide member 23. The movable hook 243 is coupled to the lower edge of the second flat plate 242 of the second guide member 24. Rotation shafts (not illustrated in the drawings) extending in the front-back direction are disposed on the upper edges of the movable hooks 233 and 243 and, when viewed from the back side, the movable hooks 233 and 243 are configured so as to be rotatable clockwise and counter-clockwise around these rotation shafts. The movable hooks 233 and 243 move between a first position and a second position by rotating around the rotation shafts. The movable hooks 233 and 243 are configured to catch the falling cardboard box C when disposed at the first position. Meanwhile, the movable hooks 233 and 243 are configured to not contact the cardboard box C when disposed at the second position.

The movable hook 233 includes a flat plate portion 233*a* and a protrusion portion 233*b*. The flat plate portion 233*a* extends parallel to (on the same imaginary plane with) the second flat plate 232 when the movable hook 233 is disposed at the first position. The protrusion portion 233*b* protrudes to the left from the lower edge of the flat plate portion 233*a* when the movable hook 233 is disposed at the first position. The protrusion portion 233*b* is orthogonal to the flat plate portion 233*a*.

The movable hook 243 includes a flat plate portion 243*a* and a protrusion portion 243*b*. The flat plate portion 243*a* extends parallel to (on the same imaginary plane with) the second flat plate 242 when the movable hook 243 is disposed at the first position. The protrusion portion 243*b* protrudes to the right from the lower edge of the flat plate portion 243*a* when the movable hook 243 is disposed at the first position. The protrusion portion 243*b* is orthogonal to the flat plate portion 243*a*.

The protrusion portions 233*b* and 243*b* catch the side face C14 of the cardboard box C when the cardboard box C is dropped.

The movable hooks 233 and 243 are moved to the second position away from the cardboard box C at the times of the up-down movement operation and the posture change operation by the holding and posture changing mechanism 50. When the movable hooks 233 and 243 have been moved to the second position, the movable hooks 233 and 243 do not contact the cardboard box C. As such, the movable hooks 233 and 243 will not obstruct the posture change operation and the up-down movement operation of the cardboard box C.

The first drive unit 25 moves the second guide members 23 and 24 in the front-back direction. In one example, the first drive unit 25 includes an air cylinder for driving the second guide members 23 and 24 in the front-back direction. Note that the first drive unit 25 may include a different drive mechanism (e.g. a motor) in place of the air cylinder. After the cardboard box C has fallen, the first drive unit 25 moves the second guide members 23 and 24 forward so that the second guide member 23 approaches the first guide member 21 and the second guide member 24 approaches the first guide member 22, respectively.

The second drive unit 26 rotatably drives the movable hooks 233 and 243 clockwise or counter-clockwise, when viewed from the back side. In one example, the second drive unit 26 includes an air cylinder for rotatably driving the movable hooks 233 and 243. Note that the second drive unit 26 may include a different drive mechanism (e.g. a motor) in place of the air cylinder.

(2-2) Push-in Mechanism

The push-in mechanism 40 pushes a plurality of articles A, transported by the article transportation unit 70, from the side into the cardboard box C, which was moved to the predetermined article push-in position by the first drive unit 25 of the dropping mechanism 20 and the holding and posture changing mechanism 50 and whose opening faces sideways.

The push-in mechanism 40 includes a push-in member 41 (see FIG. 7A) and a push-in drive unit 42 (see FIG. 3). The push-in drive unit 42 moves the push-in member 41 in the front-back direction. In one example, the push-in drive unit 42 includes an air cylinder for driving the push-in member 41 in the front-back direction. Note that the push-in drive unit 42 may include a different drive mechanism (e.g. a motor) in place of the air cylinder.

Figure 7A:
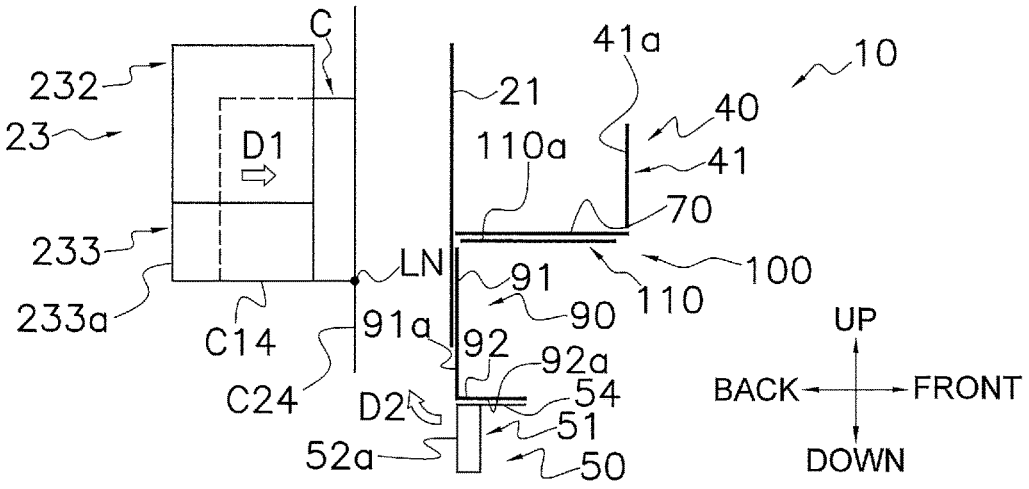
FIG. 7A is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state immediately after a cardboard box has been dropped by the dropping mechanism is depicted.

The push-in member 41 is a plate-like member that has a push-in surface 41*a* that faces the opening of the cardboard box C into which the articles A are to be pushed (see FIG. 7A). The push-in member 41 is a plate-like member that has a vertical push-in surface 41*a*.

The push-in drive unit 42 drives the push-in member 41 backward (see arrow D4 in FIG. 7C) to the vicinity of the opening of the cardboard box C when pushing the articles A into the cardboard box C. At this time, the push-in member 41 abuts against the articles A placed behind the push-in member 41 (between the push-in member 41 and the opening of the cardboard box C) and pushes the articles A into the cardboard box C through the opening thereof.

Note that, when pushing the articles A into the cardboard box C, the opening of the cardboard box C and the push-in member 41 directly face each other. As a result, the articles A are easily pushed through the opening into the cardboard box C without spilling.

(2-3) Guide/Holding Mechanism

The guide/holding mechanism 100 guides the movement of the articles A when the push-in mechanism 40 pushes the articles A into the cardboard box C whose opening faces sideways. Additionally, the guide/holding mechanism 100 holds at least a portion of the articles A stored in the cardboard box C at the time of the posture change operation of the cardboard box C by the holding and posture changing mechanism 50.

The guide/holding mechanism 100 includes a guide/holding member 110 (see FIG. 7A) and a guide/holding member drive unit 120 (see FIG. 3). The guide/holding member drive unit 120 moves the guide/holding member 110 in the front-back direction. In one example, the guide/holding member drive unit 120 includes a motor for driving the guide/holding member 110 in the front-back direction. Note that the guide/holding member drive unit 120 may include a different drive mechanism (e.g. an air cylinder) in place of the motor.

The guide/holding member 110 is an example of the guide member. The guide/holding member 110 enters the cardboard box C through the opening and uses an upper guide face 110*a* (see FIG. 7A) thereof to guide the movement of the articles A when the push-in mechanism 40 pushes the articles A into the cardboard box C whose opening faces sideways. The guide face 110*a* of the guide/holding member 110 is parallel to the bottom face (the side face C14) of the cardboard box C at a time when the push-in mechanism 40 pushes the articles A into the cardboard box C. The guide face 110*a* of the guide/holding member 110 is a horizontal face. The guide/holding member 110 has a length in the left-right direction that is less than the width in the left-right direction of the opening of the cardboard box C. This configuration allows the guide/holding member 110 to enter through the opening of the cardboard box C into the cardboard box C into which the push-in mechanism 40 pushes the articles A. Prior to the push-in drive unit 42 driving the push-in member 41, the guide/holding member drive unit 120 moves the guide/holding member 110 backward as indicated by arrow D5 in FIG. 7C, and inserts the guide/holding member 110 through the opening of the cardboard box C into the cardboard box C. The articles A pushed into the cardboard box C by the push-in member 41 move on the guide face 110*a* of the guide/holding member 110 that is inserted into the cardboard box C. While the push-in member 41 is disposed adjacent to the opening of the cardboard box C, the guide/holding member drive unit 120 moves the guide/holding member 110, which has been inserted into the cardboard box C and has the articles A placed on the guide face 110*a* thereof, forward as indicated by arrow D6 in FIG. 7D, and pulls the guide/holding member 110 out of the cardboard box C. Since movement of the articles A is restricted by the push-in member 41, the articles A are not taken away from the cardboard box C together with the guide/holding member 110 and remain in the cardboard box C (see FIG. 7E).

The guide/holding member 110 is also an example of the holding member. The guide/holding member 110 holds at least a portion of the articles A stored in the cardboard box C at the time of the posture change operation of the cardboard box C by the holding and posture changing mechanism 50. The function of the guide/holding member 110 as the holding member will be described later together with the operations of the boxing apparatus 10.

(2-4) Holding and Posture Changing Mechanism

The holding and posture changing mechanism 50 holds the cardboard box C, whose opening faces sideways, when the push-in mechanism 40 is pushing the articles A into the cardboard box C. Additionally, the holding and posture changing mechanism 50 adjusts the height position of the cardboard box C. Furthermore, after the push-in mechanism 40 has pushed the articles A into the cardboard box C, the holding and posture changing mechanism 50 rotates the cardboard box C, whose opening faces sideways, such that the opening faces upward, to change the posture of the cardboard box C.

Figure 6:
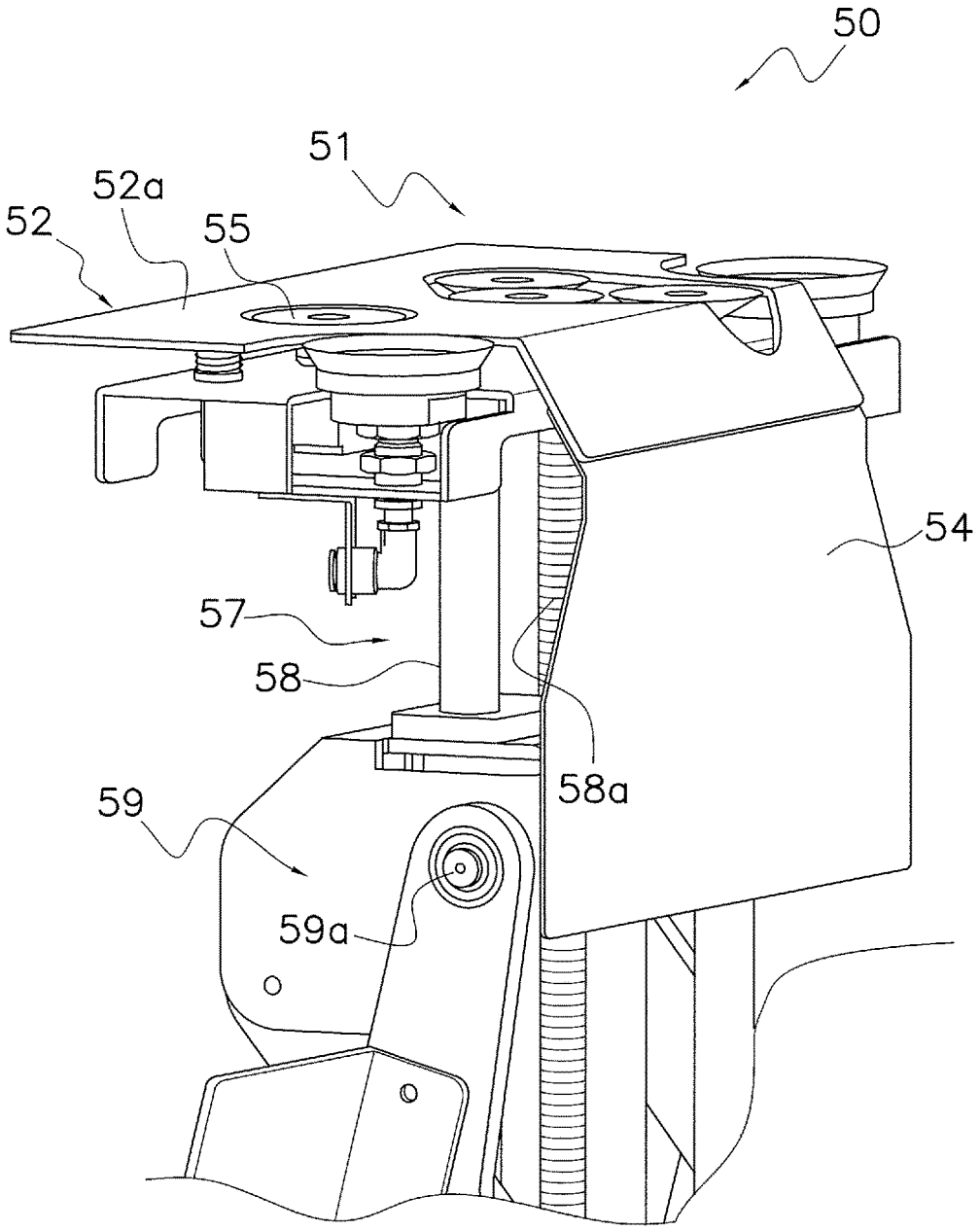
FIG. 6 is a perspective view of the holding and posture changing mechanism of the boxing apparatus depicted in FIG. 1, wherein the holding and posture changing mechanism is viewed from the front-right side, and a state is depicted in which the abutting surface of the abutting plate of the holding and posture changing mechanism faces upward.

As illustrated in FIG. 6, the holding and posture changing mechanism 50 includes a suction unit 51, a support unit 57 supporting the suction unit 51, and a rotation portion 59 that allows the posture of the suction unit 51 to be changed.

(2-4-1) Suction Unit

The suction unit 51 suctions onto the outer surface of the side face C14 of the cardboard box C, which works as the bottom face of the cardboard box C when the articles A are pushed in by the push-in mechanism 40.

Figure 7B:
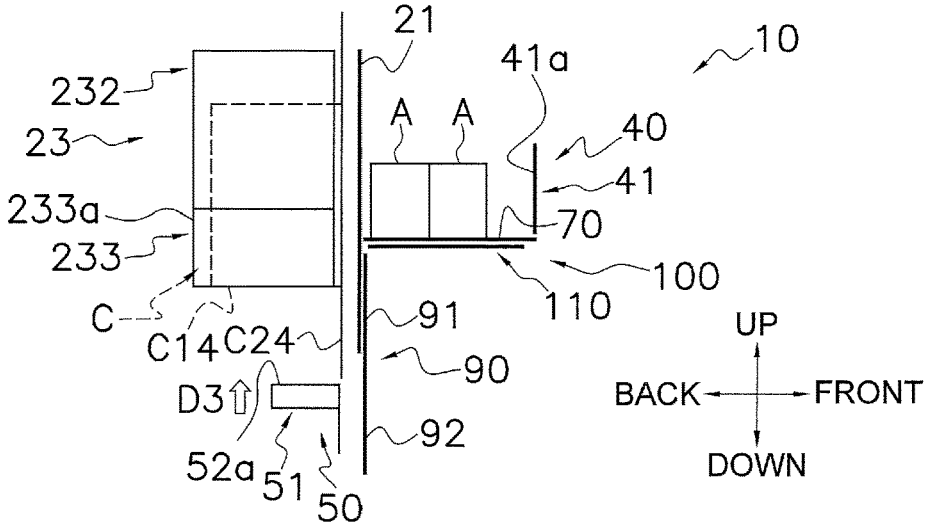
FIG. 7B is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state is depicted in which a second guide member of the dropping mechanism has been driven so as to approach a first guide member, and a rotating member of the holding and posture changing mechanism has changed the posture of a suction unit so that the abutting surface of the abutting plate faces upward.
Figure 7C:
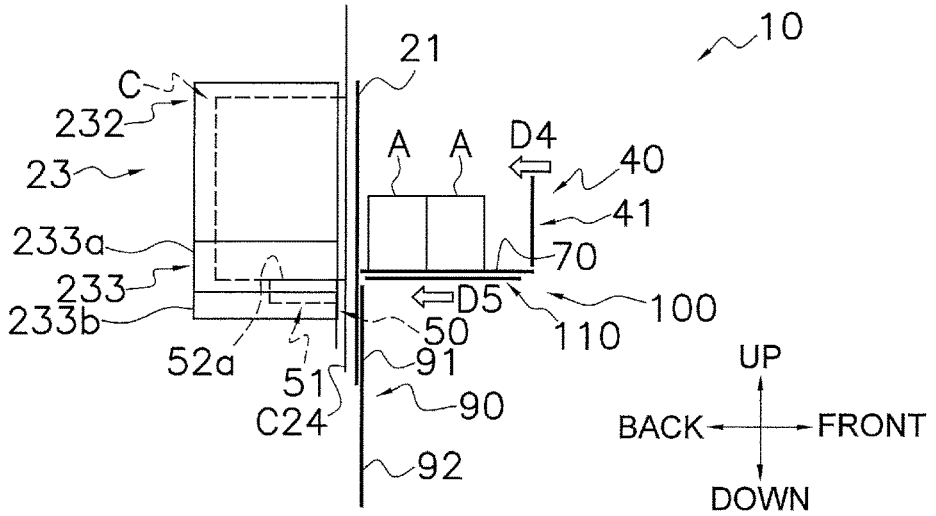
FIG. 7C is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state prior to the articles being pushed into the cardboard box by a push-in mechanism is depicted in which the holding and posture changing mechanism has moved the cardboard box to an article push-in position (article push-in height)

As illustrated in FIG. 7C, the suction unit 51 suctions from below onto the outer surface of the bottom face (the side face C14) of the cardboard box C which the second guide members 23 and 24 of the dropping mechanism 20 has moved forward and horizontally to the article push-in position when viewed planarly. When the suction unit 51 has suctioned onto the side face C14 of the cardboard box C, whose opening faces sideways, the suction unit 51 remains suctioned onto the side face C14 of the cardboard box C at least until the holding and posture changing mechanism 50 finishes rotating the cardboard box C so that the opening faces upward.

The suction unit 51 mainly includes an abutting plate 52, a pressing plate 54, a suction pad 55, and a suction drive unit 61 (see FIGS. 3 and 6).

The abutting plate 52 is a plate-like member. Holes, through which the suction pad 55 are inserted, are formed in the abutting plate 52. The abutting plate 52 has an abutting surface 52*a* that abuts against the side face C14 when the suction unit 51 suctions onto the side face C14 of the cardboard box C (see FIG. 6). The abutting surface 52*a* of the abutting plate 52 faces upward when the holding and posture changing mechanism 50 is holding the cardboard box C whose opening faces sideways. At this time, the abutting surface 52*a* is a horizontal surface.

The pressing plate 54 is a plate member that is attached so as to extend from the edge of the abutting plate 52. In a state in which the abutting surface 52*a* of the abutting plate 52 faces upward, the pressing plate 54 is disposed on the front side of the abutting plate 52. The pressing plate 54 extends in the vertical direction when the abutting surface 52*a* of the abutting plate 52 is horizontal. When the rotation portion 59 rotates the suction unit 51 from a state in which the abutting surface 52*a* faces upward to a state in which the abutting surface 52*a* faces backward, the pressing plate 54 presses a second spill-prevention surface 92*a* of a rotating portion 92 of the spill-prevention mechanism 90 (described later) forward (in a direction away from the cardboard box C) and rotates the rotating portion 92.

The suction drive unit 61 drives the suction pad 55. The suction pad 55 suctions onto the outer surface of side face C14, which works as the bottom face of the cardboard box C when the push-in mechanism 40 pushes the articles A into the cardboard box C. The suction pad 55 suctions onto a predetermined position of the outer surface of the side face C14.

The suction drive unit 61 is an air pump that is connected to the suction pad 55 via a hose (not illustrated in the drawings) and suctions air through the hose to generate negative pressure in the suction pad 55.

(2-4-2) Support Unit

The support unit 57 includes a rod 58 that supports the suction unit 51. The rod 58 extends in a direction perpendicular to the abutting surface 52*a* of the abutting plate 52 of the suction unit 51. The rod 58 supports the suction unit 51 from below when the abutting surface 52*a* of the abutting plate 52 faces upward.

The support unit 57 also includes a vertical drive unit 62. In one example, the vertical drive unit 62 is a motor that drives a ball screw 58*a*. The vertical drive unit 62 drives the rod 58 by rotating the ball screw 58*a*, and then drives the suction unit 51 with the abutting surface 52*a* facing upward in the up-down direction. The vertical drive unit 62 moves the suction unit 51 up and down while the suction unit 51 suctions onto the outer surface of the side face C14 of the cardboard box C, whose opening faces sideways (forward), to adjust the height position of the cardboard box C when the push-in mechanism 40 pushes the articles A into the cardboard box C.

(2-4-3) Rotation Portion

The rotation portion 59 rotates the posture of the suction unit 51 around a rotation shaft 59*a* extending in the left-right direction. That is, the rotation portion 59 rotates the posture of the suction unit 51 around the rotation shaft 59*a* that is parallel to a boundary line LN (see FIG. 7A) between the opening of the cardboard box C and the side face C14 which works as the bottom face of the cardboard box C when the articles A are pushed in by the push-in mechanism 40. In other words, the rotation portion 59 rotates the posture of the suction unit 51 around the rotation shaft 59*a* that is generally parallel to the boundary line LN between the side face C14, which works as the bottom face of the cardboard box C when the articles A are pushed in by the push-in mechanism 40, and the flap C24 extending from the side face C14.

Figure 7D:
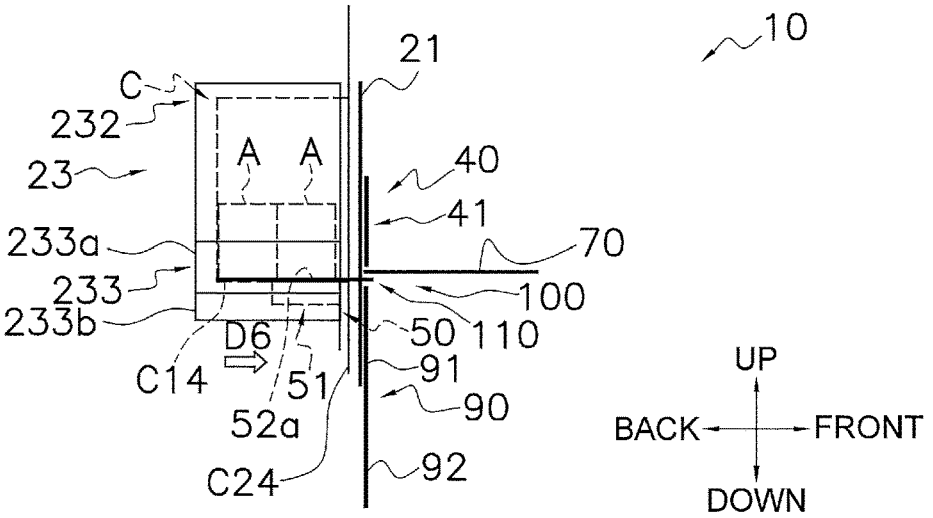
FIG. 7D is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state is depicted in which a guide/holding member has entered into the cardboard box, and a push-in member of the push-in mechanism has pushed the articles into the cardboard box.
Figure 7E:
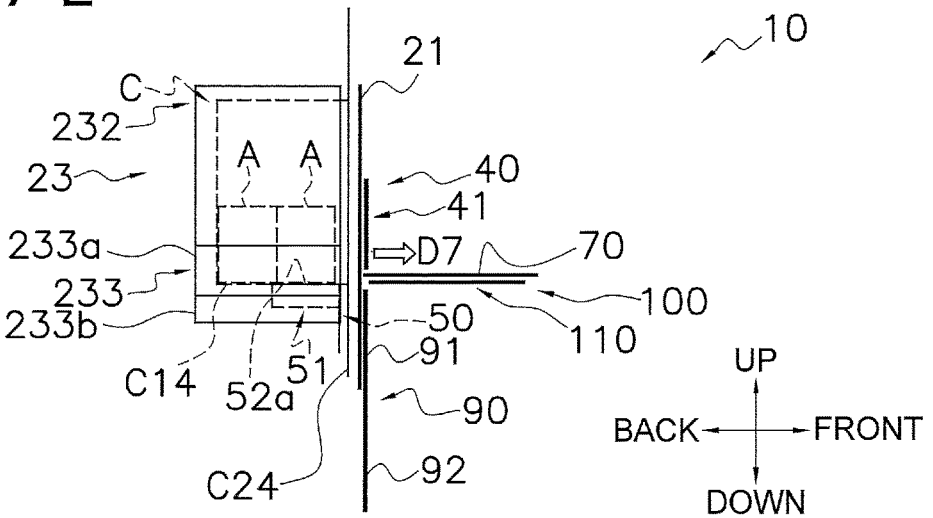
FIG. 7E is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state is depicted in which the guide/holding member has been pulled out of the cardboard box after a first layer of the articles has been pushed into the cardboard box.

The rotation portion 59 rotates the suction unit 51, in which the abutting surface 52*a* of the abutting plate 52 faces backward, 90 degrees in the direction of arrow D2 illustrated in FIG. 7A so that the abutting surface 52*a* faces upward (see FIGS. 7A and 7B). Additionally, the rotation portion 59 rotates the suction unit 51, in which the abutting surface 52*a* faces upward, 90 degrees in the direction of arrow D8 illustrated in FIG. 7F so that the abutting surface 52*a* faces backward (see FIGS. 7F and 7H).

The rotation portion 59 includes a rotation drive unit 63 for rotating the suction unit 51 (see FIG. 3). In one example, the rotation drive unit 63 is an air cylinder. Note that the rotation drive unit 63 may be a drive mechanism (e.g. a motor) other than an air cylinder.

(2-5) Spill-Prevention Mechanism

The spill-prevention mechanism 90 is a plate-like member and, as illustrated in FIG. 7C, extends further downward from below the article push-in position at which the push-in mechanism 40 pushes the articles A into the cardboard box C.

The spill-prevention mechanism 90 includes a vertical plate 91 and a rotating portion 92 extending from the lower edge of the vertical plate 91. The vertical plate 91 is an immovable member that extends in the up-down direction. The rotating portion 92 is a member that is capable of rotating around a rotation shaft that extends in the left-right direction and is provided on the lower edge of the vertical plate 91. That is, the rotating portion 92 is a member that is capable of rotating around a rotation shaft that is parallel to the rotation shaft 59*a* of the rotation portion 59. When viewed from the right side, the rotating portion 92 is capable of rotating 90 degrees counter-clockwise from the vertical state illustrated in FIG. 7F (see FIG. 7H).

Figure 7F:
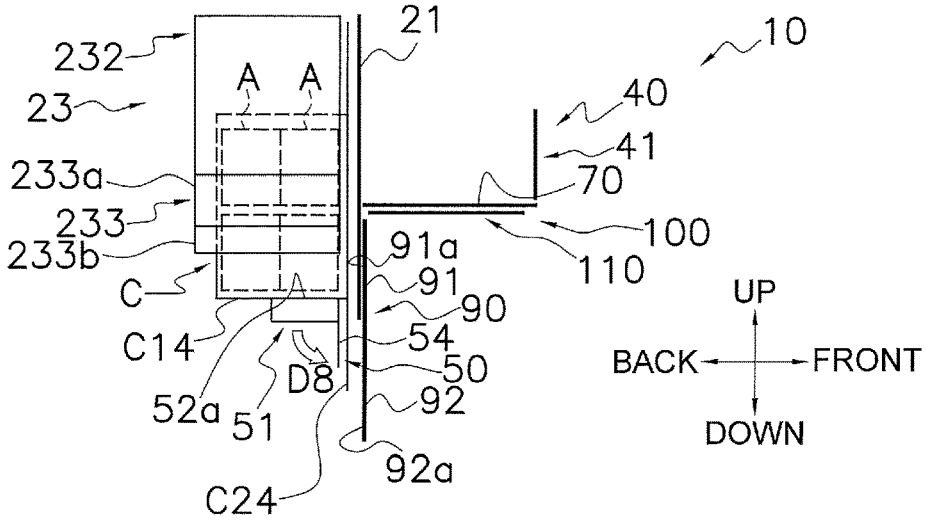
FIG. 7F is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state immediately prior to the holding and posture changing mechanism performing a posture change operation of the cardboard box is depicted in which the articles in the uppermost layer (the articles in a second layer) have also been stored.

The vertical plate 91 and the rotating portion 92 respectively include a first spill-prevention surface 91*a* and a second spill-prevention surface 92*a* on the back sides thereof (see FIG. 7F). The first spill-prevention surface 91*a* and the second spill-prevention surface 92*a* face the opening of the cardboard box C. The first spill-prevention surface 91*a* is a flat surface extending in the left-right direction and the up-down direction. The first and second spill-prevention surfaces 91*a* and 92*a* are disposed on identical planes when the cardboard box C, in which the articles A have been stored, is driven in the up-down direction by the vertical drive unit 62 of the holding and posture changing mechanism 50. That is, the second spill-prevention surface 92*a* is a flat surface that extends in the left-right direction and the up-down direction when the cardboard box C, in which the articles A have been stored, is driven in the up-down direction by the holding and posture changing mechanism 50. The first and second spill-prevention surfaces 91*a* and 92*a* close the opening of the cardboard box C and reduce the possibility that the articles A spill out of the cardboard box C when the cardboard box C, in which the articles A have been stored, is driven in the up-down direction by the holding and posture changing mechanism 50. Note that a spring (not illustrated in the drawings) is provided on the rear (front side) of the rotating portion 92 as an elastic member, and this spring biases the rotating portion 92 backward. As such, the rotating portion 92 will not easily rotate forward even if the articles A in the cardboard box C push against the rotating portion 92.

When the rotation portion 59 rotates the posture of the suction unit 51 so that the upward-facing abutting surface 52*a* turns to face backward, the pressing plate 54 of the suction unit 51 presses the second spill-prevention surface 92*a* of the rotating portion 92 in the direction away from the cardboard box C (forward). The second spill-prevention surface 92*a* is pressed by the pressing plate 54 via the flap C24 of the cardboard box C, and is not directly pressed on by the pressing plate 54 (see FIG. 7H).

The rotating portion 92 is provided on the lower edge of the vertical plate 91. As such, the spill-prevention mechanism 90 does not obstruct the rotation of the posture of the suction unit 51 and reduces the possibility that the articles A spill from the position at which the opening of the cardboard box C faces the spill-prevention mechanism 90 up to immediately prior to the posture of the suction unit 51 being rotated (up to immediately prior to the holding and posture changing mechanism 50 beginning to raise the cardboard box C).

(2-6) Article Transportation Unit

The article transportation unit 70 (see FIG. 7A) transports the articles A which is to be packaged in the cardboard box C.

A transportation drive unit 71 (see FIG. 3) drives the article transportation unit 70 so that the articles A are transported at a predetermined speed and timing. Specifically, the transportation drive unit 71 drives the article transportation unit 70 so that the articles A are transported to behind the push-in member 41 of the push-in mechanism 40 (between the push-in member 41 and the opening of the cardboard box C) when the first drive unit 25 and the support unit 57 of the holding and posture changing mechanism 50 have moved the cardboard box C to the predetermined article push-in position.

(2-7) Conveyor

The conveyor 75 (see FIG. 7H) is a transportation mechanism that supplies the cardboard box C, whose posture has been changed by the holding and posture changing mechanism 50 (the opening has been faced upward), to the box closing apparatus 3. The conveyor 75 transports the cardboard box C, whose opening has been faced upward, to the left.

The conveyor 75 is driven by a conveyor drive unit 76 (see FIG. 3), and transports the cardboard box C at a predetermined speed and timing.

(2-8) Control Device

The control device 80 is electrically connected to the various components of the boxing apparatus 10 including the dropping mechanism 20, the push-in mechanism 40, the guide/holding mechanism 100, the holding and posture changing mechanism 50, the article transportation unit 70, and the conveyor 75 (see FIG. 3). Additionally, the control device 80 is electrically connected to the box making apparatus 2 disposed at the stage preceding to the boxing apparatus 10 and the box closing apparatus 3 disposed at the stage subsequent to the boxing apparatus 10. The control device 80 controls the various components of the boxing apparatus 10.

As illustrated in FIG. 3, the control device 80 includes a storage unit 81 and a control unit 82. In one example, the storage unit 81 is configured from ROM, RAM, a hard disk (HDD), and the like. The control unit 82 is mainly configured from a CPU.

(2-8-1) Storage Unit

Various programs to be executed by the control unit 82 are stored in the storage unit 81. Additionally, various operating parameters needed for the control unit 82 to control the boxing apparatus 10 are stored in the storage unit 81.

(2-8-2) Control Unit

The control unit 82 reads out and executes the programs stored in the storage unit 81, and controls the various components of the boxing apparatus 10 including the dropping mechanism 20, the push-in mechanism 40, the guide/holding mechanism 100, the holding and posture changing mechanism 50, the article transportation unit 70, and the conveyor 75.

For example, the control unit 82 controls the push-in drive unit 42 of the push-in mechanism 40 to move the push-in member 41 forward and backward. Additionally, for example, the control unit 82 controls the rotation drive unit 63 of the holding and posture changing mechanism 50 to rotate the suction unit 51 suctioned onto the side face C14 of the cardboard box C and raise the cardboard box C, whose opening faces sideways, such that the opening faces upward. Moreover, for example, the control unit 82 controls the vertical drive unit 62 of the holding and posture changing mechanism 50 to move the suction unit 51 suctioned onto the side face C14 of the cardboard box C up and down to adjust the height position of the cardboard box C. Furthermore, prior to the push-in mechanism 40 pushing the articles A into the cardboard box C, the control unit 82 controls the guide/holding member drive unit 120 of the guide/holding member 110 to move the guide/holding member 110 backward so as to enter into the cardboard box C. Additionally, at the time of the posture change operation of the cardboard box C by the holding and posture changing mechanism 50, the control unit 82 controls the guide/holding member drive unit 120 of the guide/holding mechanism 100 to move the guide/holding member 110 backward so that the guide/holding member 110 holds at least a portion of the articles A stored in the cardboard box C.

(3) Operations of Boxing Apparatus

The operations of the boxing apparatus will be described using FIGS. 7A to 7H and FIG. 8. FIGS. 7A to 7H are drawings explaining the operations of the boxing apparatus 10. FIGS. 7A to 7H are schematic side views of the surroundings of the holding and posture changing mechanism 50, as seen from the right side. FIG. 8 is a flowchart explaining the operations of the boxing apparatus 10.

First, in step S1, upon a command from the control device 80, the dropping mechanism 20 drops a cardboard box C supplied from the box making apparatus 2 and changes the height position of this cardboard box C. In step S1, the cardboard box C is dropped such that the flap C21 passes between the first guide member 21 and the first flat plate 231 of the second guide member 23, and the flap C23 passes between the first guide member 22 and the first flat plate 241 of the second guide member 24. Additionally, in step S1, the cardboard box C is dropped such that the side face portion C1 of the cardboard box C passes between the second flat plate 232 of the second guide member 23 and the second flat plate 242 of the second guide member 24. The cardboard box C falls on the protrusion portions 233*b* and 243*b* of the movable hooks 233 and 243, which are positioned at the first position, of the second guide members 23 and 24, and is caught by the protrusion portions 233*b* and 243*b*. The falling of the cardboard box C ends at this time when the cardboard box C is caught by the protrusion portions 233*b* and 243*b*.

In step S2, upon a command from the control device 80, the first drive unit 25 of the dropping mechanism 20 moves the second guide member 23 forward as indicated by arrow D1 in FIG. 7A. Also, the first drive unit 25 moves the second guide member 24 forward at the same timing and speed. At this time, the second guide members 23 and 24 respectively contact the rear faces of the flap C21 and the flap C23 of the cardboard box C, and move the cardboard box C forward (see FIG. 7B).

Furthermore, in step S2, upon a command from the control device 80, the rotation drive unit 63 of the holding and posture changing mechanism 50 rotates the suction unit 51 around the rotation shaft 59*a*, which extends in the left-right direction, as indicated by arrow D2 in FIG. 7A. As a result, as illustrated in FIG. 7A, the posture of the suction unit 51 is changed so that abutting surface 52*a* of the abutting plate 52 that was facing backward faces (upward) the side face C14 which is arranged at the bottom of the cardboard box C as illustrated in FIG. 7B.

In step S3, upon a command from the control device 80, the vertical drive unit 62 of the holding and posture changing mechanism 50 moves the suction unit 51 in the direction indicated by arrow D3 in FIG. 7B (upward) so that the abutting surface 52*a* of the abutting plate 52 abuts against the side face C14 of the cardboard box C. Furthermore, upon a command from the control device 80, the suction pad 55 driven by the suction drive unit 61 suctions onto the side face C14 which is arranged at the bottom of the cardboard box C, thereby joining the suction unit 51 to the cardboard box C.

Additionally, in step S3, upon a command from the control device 80, the second drive unit 26 rotatably drives the movable hooks 233 and 243 in the direction away from the cardboard box C. The second drive unit 26 moves the movable hooks 233 and 243 to the second position. As a result, the movable hooks 233 and 243 no longer contact the cardboard box C and the cardboard box C comes to be held from below by the suction unit 51.

In step S4, upon a command from the control device 80, the vertical drive unit 62 moves the suction unit 51 upward or downward to the predetermined position. As a result, the cardboard box C, which is supported from below by the suction unit 51, is moved upward or downward. The cardboard box C is moved to the article push-in position at which the articles A are pushed in (the height position at which the articles A are pushed in) (see FIG. 7C).

In step S5, upon a command from the control device 80, the guide/holding member drive unit 120 moves the guide/holding member 110 backward as indicated by arrow D5 in FIG. 7C, and inserts the guide/holding member 110 into the cardboard box C. The guide/holding member 110 is inserted into the cardboard box C such that the back edge thereof arrives at the vicinity of the bottom lid B of the cardboard box C.

Additionally, in step S5, after the guide/holding member 110 has been inserted into the cardboard box C, the push-in drive unit 42 moves the push-in member 41 backward as indicated by arrow D4 in FIG. 7C upon a command from the control device 80. The push-in drive unit 42 moves the push-in member 41 backward to the vicinity of the opening of the cardboard box C. At the timing at which the push-in drive unit 42 moves the push-in member 41 backward, a predetermined quantity of the articles A has been transported by the article transportation unit 70 to the back side of the push-in member 41. The push-in member 41 abuts against the articles A and pushes the articles A into the cardboard box C. The articles A pushed by the push-in member 41 move on the guide face 110*a* of the guide/holding member 110 and enter into the cardboard box C.

In step S6, upon a command from the control device 80, the guide/holding member drive unit 120 moves the guide/holding member 110 forward as indicated by arrow D6 in FIG. 7D, and pulls the guide/holding member 110 out of the cardboard box C. The push-in member 41 restricts the movement of the articles A when the guide/holding member 110 is being pulled out of the cardboard box C. As such, the articles A are not carried out of the cardboard box C together with the guide/holding member 110 and remain in the cardboard box C.

In step S7, upon a command from the control device 80, the push-in drive unit 42 moves the push-in member 41 forward as indicated by arrow D7 in FIG. 7E.

In the present embodiment, a plurality of layers of the articles A are stored in the cardboard box C. That is, the push-in mechanism 40 pushes the articles A into the cardboard box C located at a plurality of height positions. Therefore, steps S4 to S7 are repeated a number of times (two times in the present embodiment) that corresponds to the number of layers of the articles A (step S8).

In step S9, upon a command from the control device 80, the vertical drive unit 62 moves the suction unit 51 upward or downward to the position at which the suction unit 51 is rotated by the rotation portion 59 (to the height position at which the rotation portion 59 can rotate the suction unit 51 around the rotation shaft 59*a*).

In step S10, upon a command from the control device 80, the first drive unit 25 moves the second guide members 23 and 24 in a direction opposite to that in step S2 or, in other words, backward. Since the space between the first guide members 21 and 22 and the second guide members 23 and 24 increases when the second guide members 23 and 24 are moved backward, the suction unit 51 suctioned onto the side face C14 of the cardboard box C can rotate around the rotation shaft 59*a*.

Figure 7G:
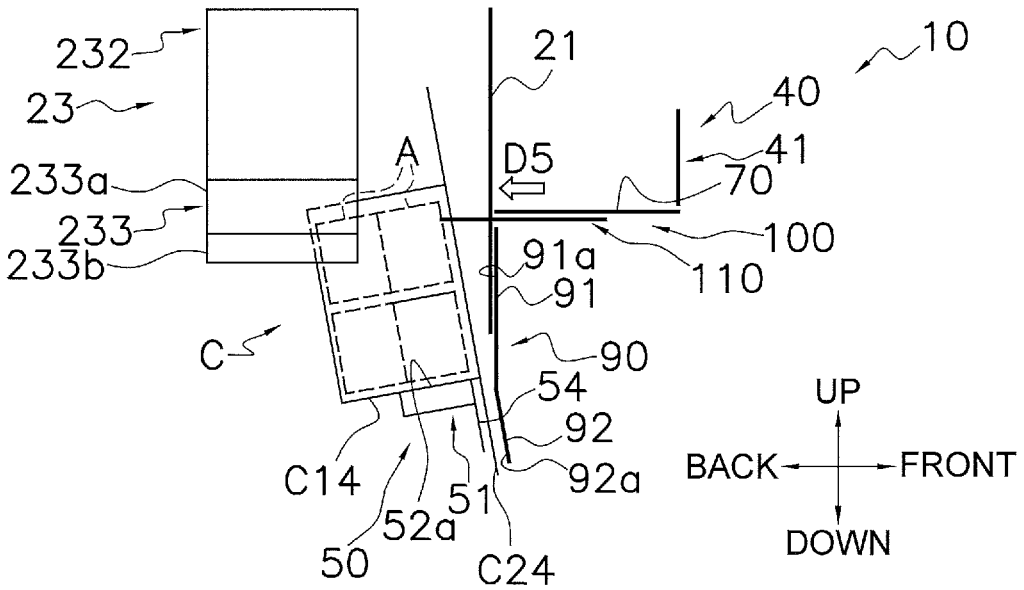
FIG. 7G is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein an initial state of the posture change operation of the cardboard box by the holding and posture changing mechanism is depicted, and a state in which the guide/holding member is holding the articles stored in the cardboard box is depicted.
Figure 7H:
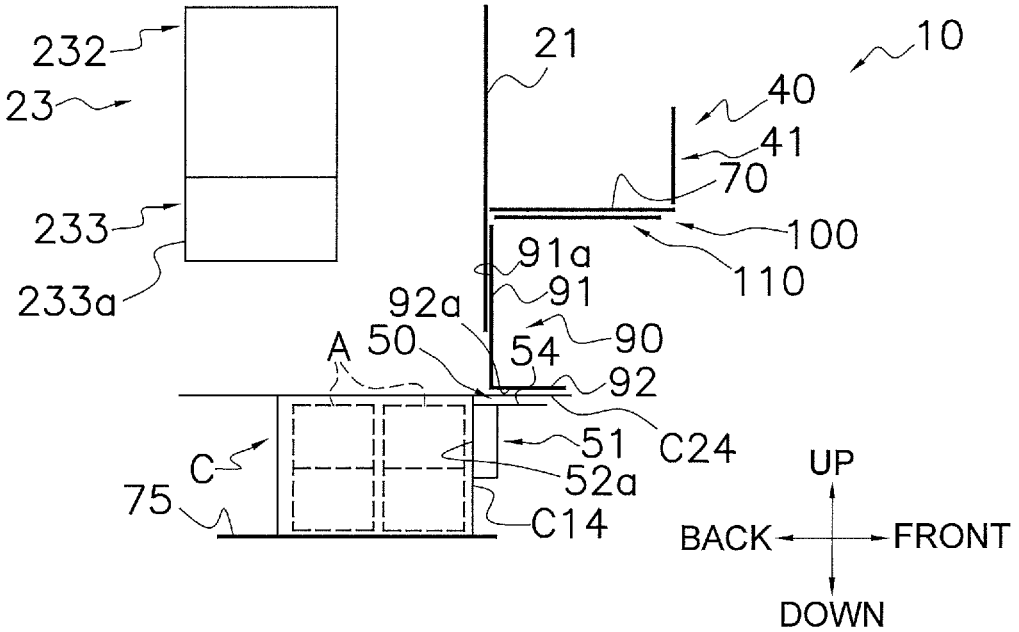
FIG. 7H is a drawing explaining an operation of the boxing apparatus depicted in FIG. 1, and is a schematic side view depicting the surroundings of the holding and posture changing mechanism of the boxing apparatus depicted in FIG. 1 from the right side of FIG. 4, wherein a state is depicted in which the posture change operation of the cardboard box by the holding and posture changing mechanism has completed (a state in which the cardboard box has been rotated and the opening faces upward)
Figure 8:
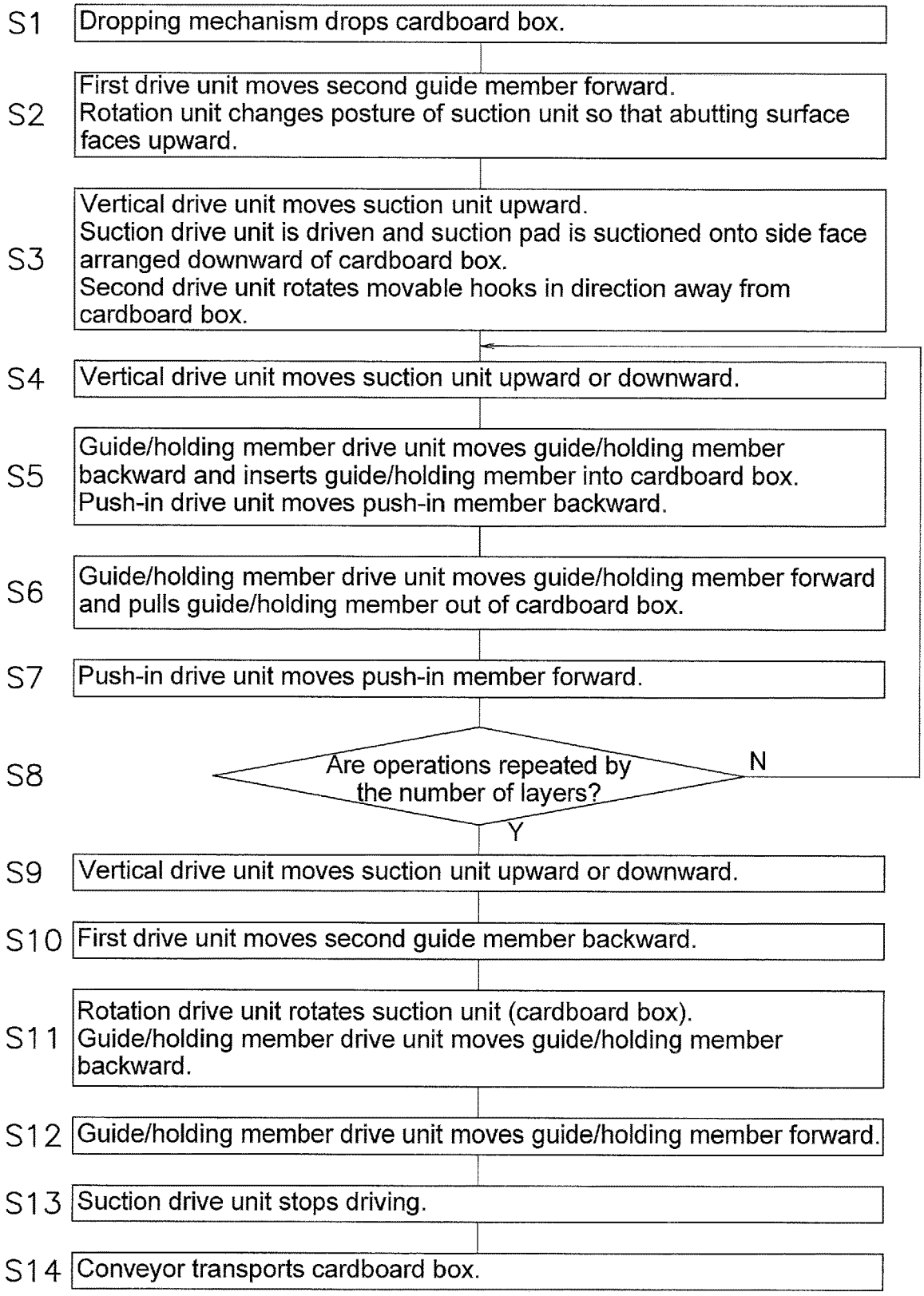
FIG. 8 is a flowchart explaining the operations of the boxing apparatus depicted in FIG. 1.

In step S11, upon a command from the control device 80, the rotation drive unit 63 rotates the suction unit 51 around the rotation shaft 59*a* while the suction unit 51 suctions onto the side face C14 of the cardboard box C (see FIG. 7G). When viewed from the right side, the rotation drive unit 63 rotates the suction unit 51 counter-clockwise while the suction unit 51 suctions onto the side face C14 of the cardboard box C (see FIG. 7G).

Additionally, in step S11, upon a command from the control device 80, the guide/holding member drive unit 120 moves the guide/holding member 110 backward as indicated by arrow D5 in FIG. 7G In other words, in step S11, upon a command from the control device 80, the guide/holding member drive unit 120 moves the guide/holding member 110 toward the articles A stored in the cardboard box C. In step S11, due to the guide/holding member 110 being moved as described above, the guide/holding member 110 holds at least a portion of the articles A stored in the cardboard box C at the time of the posture change operation of the cardboard box C by the holding and posture changing mechanism 50. Specifically, due to the guide/holding member 110 being moved, the guide/holding member 110 holds the articles A disposed in the uppermost layer (the second layer from the bottom) in the cardboard box C, whose opening faces sideways, at the time of the posture change operation of the cardboard box C by the holding and posture changing mechanism 50. The guide/holding member 110 holds the back side in the movement direction of the articles A stored in the cardboard box C at the time of the posture change operation of the cardboard box C by the holding and posture changing mechanism 50. In other words, the guide/holding member 110 holds the back side in the movement direction of the articles A (forward side of the articles A) so as to follow the articles A stored in the cardboard box C at the time of the posture change operation of the cardboard box C by the holding and posture changing mechanism 50.

The guide/holding member 110 holds at least a portion of the articles A stored in the cardboard box C during at least an initial stage of the posture change operation of the cardboard box C by the holding and posture changing mechanism 50. The opening of the cardboard box C generally faces sideways during the initial stage of the posture change operation of the cardboard box C. As such, gravity is not likely to act as a force to suppress the articles A from flying out through the opening. Therefore, it is particularly effective that the guide/holding member 110 holds at least a portion of the articles A stored in the cardboard box C during the initial stage of the posture change operation of the cardboard box C by the holding and posture changing mechanism 50.

Specifically, it is preferable that the guide/holding member 110 holds at least a portion of the articles A stored in the cardboard box C from when the holding and posture changing mechanism 50 starts to rotate the cardboard box C, whose opening faces sideways, until when the holding and posture changing mechanism 50 rotates the cardboard box C by at least five degrees. In other words, it is preferable that the guide/holding member 110 holds at least a portion of the articles A stored in the cardboard box C until the horizontal abutting surface 52*a* of the abutting plate 52 of the suction unit 51 is inclined at least five degrees with respect to the horizontal plane by the holding and posture changing mechanism 50. Note that, it is more preferable that the guide/holding member 110 holds at least a portion of the articles A stored in the cardboard box C from when the holding and posture changing mechanism 50 starts to rotate the cardboard box C, whose opening faces sideways, until when the holding and posture changing mechanism 50 rotates the cardboard box C by ten degrees. It is even more preferable that the guide/holding member 110 holds at least a portion of the articles A stored in the cardboard box C from when the holding and posture changing mechanism 50 starts to rotate the cardboard box C, whose opening faces sideways, until when the holding and posture changing mechanism 50 rotates the cardboard box C by 30 degrees.

Note that, in this case, the guide/holding member 110 holds at least a portion of the articles A stored in the cardboard box C and further pushes the articles A into the cardboard box C at the time of the posture change operation of the cardboard box C by the holding and posture changing mechanism 50. However, the present invention is not limited thereto, and a configuration is possible in which the guide/holding member 110 only holds the articles A against which the guide/holding member 110 is abutted so that the articles A stored in the cardboard box C do not fly out through the opening at the time of the posture change operation of the cardboard box C by the holding and posture changing mechanism 50.

Regardless, by configuring such that the guide/holding member 110 pushes the articles A into the cardboard box C, it will be much easier to reduce the possibility that the articles A stored in the cardboard box C fly out through the opening.

Particularly, when the articles A are bag products made from a flexible packing material, beneficial effects such as that described below can be obtained by configuring the guide/holding member 110 to push the articles A into the cardboard box C.

When the guide/holding member 110 pushes bag products as the articles A into the cardboard box C, the bag products pushed by the guide/holding member 110 swell in the up-down direction. As a result, contact surface area increases between the pushed bag products and the vertically adjacent bag products and/or the inner surface of the vertically adjacent side faces of the cardboard box C. As a result of the contact surface area increasing between the pushed bag products and the vertically adjacent bag products and/or the inner surface of the vertically adjacent side faces of the cardboard box C, frictional forces opposing the bag products flying out of the cardboard box C increase and the bag products pushed into the cardboard box C are less likely to fly out of the cardboard box C.

In step S11, the control device 80 causes the guide/holding member drive unit 120 to move the guide/holding member 110 backward prior to the rotation drive unit 63 rotating the suction unit 51.

However, the timing at which the rotation drive unit 63 rotates the suction unit 51 and the guide/holding member drive unit 120 moves the guide/holding member 110 backward are not limited thereto. Provided that the guide/holding member 110 can hold at least a portion of the articles A stored in the cardboard box C, a configuration is possible in which, for example, the control device 80 simultaneously causes the rotation drive unit 63 to rotate the suction unit 51 and the guide/holding member drive unit 120 to move the guide/holding member 110 backward. Additionally, provided that the guide/holding member 110 can hold at least a portion of the articles A stored in the cardboard box C, a configuration is possible in which, for example, the control device 80 causes the rotation drive unit 63 to rotate the suction unit 51 and, thereafter, causes the guide/holding member drive unit 120 to move the guide/holding member 110 backward.

Note that, the configuration described below is preferable for cases in which the guide/holding member 110 holds the articles A stored in the cardboard box C, which is moved backward due to the posture change operation of the cardboard box C by the holding and posture changing mechanism 50, and further pushes the articles A into the cardboard box C.

The guide/holding member 110 holds the articles A stored in the cardboard box C while moving in a first direction (backward). It is preferable that the magnitude of the movement speed of the guide/holding member 110 when holding the articles A stored in the cardboard box C is larger than the magnitude of the first direction component of the movement speed of the articles A to be held by the guide/holding member 110.

However, provided that the guide/holding member 110 can hold the articles A stored in the cardboard box C, a configuration is possible in which, for example, the magnitude of the movement speed of the guide/holding member 110 when holding the articles A stored in the cardboard box C is equal to the magnitude of the first direction component of the movement speed of the articles A to be held by the guide/holding member 110.

In step S12, upon a command from the control device 80, the guide/holding member drive unit 120 stops the backward movement of the guide/holding member 110 at a predetermined position and moves the guide/holding member 110 in a direction (forward) opposite to that indicated by arrow D5 in FIG. 7G. When a subsequent cardboard box C is to be dropped by the dropping mechanism 20, the guide/holding member 110 is moved to the position where the guide/holding member 110 will not contact the falling cardboard box C. The guide/holding member drive unit 120 may move the guide/holding member 110 forward after the guide/holding member 110 ceases contacting the articles A in the cardboard box C. Alternately, the guide/holding member drive unit 120 may move the guide/holding member 110 forward when the guide/holding member 110 is still in contact with the articles A in the cardboard box C. The movement of the guide/holding member 110 may be appropriately determined so as to enable to reduce the possibility that the articles A stored in the cardboard box C fly out of the cardboard box C.

Note that the posture change operation of the cardboard box C by the holding and posture changing mechanism 50 (the rotation, by the rotation drive unit 63, of the suction unit 51 while suctioned onto the side face C14 of the cardboard box C) is continued until the opening of the cardboard box C faces upward. In other words, the posture change operation of the cardboard box C by the holding and posture changing mechanism 50 is continued until the abutting surface 52*a* of the abutting plate 52 faces backward. The cardboard box C, rotated such that the opening faces upward, comes to a state in which the bottom lid B faces downward. The cardboard box C is loaded on the conveyor 75 at the point in time at which the posture change operation of the cardboard box C by the holding and posture changing mechanism 50 is completed (see FIG. 7H).

When the posture change operation of the cardboard box C by the holding and posture changing mechanism 50 is completed and the cardboard box C, whose bottom lid B faces downward, is loaded on the conveyor 75, the suction drive unit 61 ceases driving and the suction pad 55 detaches from the outer surface of the side face C14 upon a command from the control device 80 (step S13).

In step S14, upon a command from the control device 80, the conveyor drive unit 76 drives the conveyor 75. The cardboard box C which is loaded on the conveyor 75 and in which the articles A are accommodated is transported to the left to the box closing apparatus 3.

(4) Features (4-1)

The boxing apparatus 10 according to the present embodiment includes the push-in mechanism 40, the holding and posture changing mechanism 50, and the guide/holding member 110. The push-in mechanism 40 laterally pushes a plurality of the articles A into the cardboard box C whose opening faces sideways. The holding and posture changing mechanism 50 holds the cardboard box C, whose opening faces sideways, and changes the posture of the cardboard box C, after the articles A have been pushed into the cardboard box C by the push-in mechanism 40, by rotating the cardboard box C whose opening faces sideways, such that the opening faces upward. The guide/holding member 110 holds at least a portion of the articles A stored in the cardboard box C at the time of the posture change operation of the cardboard box C by the holding and posture changing mechanism 50.

Here, when rotating the cardboard box C to change the posture of the cardboard box C, the guide/holding member 110 holds at least a portion of the articles A stored in the cardboard box C. As a result, the possibility that the articles A fly out through the opening due to inertial forces can be reduced, even when the rotation speed of the cardboard box C is large. Therefore, a highly reliable and efficient boxing apparatus can be achieved in which the possibility that the articles A fly out of the cardboard box C at the time of the posture change operation by the holding and posture changing mechanism 50 is reduced, and the posture of the cardboard box C can be changed in a short period of time.

Furthermore, in this case, the guide/holding member 110 holds at least a portion of the articles A stored in the cardboard box C when the posture of the cardboard box C is changed. As such, it is possible to decrease the probability that the storage state of the articles A in the cardboard box C become cluttered as a result of the articles A moving and/or the posture of the articles A changing in the cardboard box C. The advantageous effects are particularly remarkable in cases in which the articles A are bag products made from flexible packing material.

(4-2)

With the boxing apparatus 10 according to the present embodiment, the guide/holding member 110 holds the back side in the movement direction of the articles A stored in the cardboard box C at the time of the posture change operation of the cardboard box C by the holding and posture changing mechanism 50.

With this configuration, the guide/holding member 110 holds the back side in the movement direction of the articles A. As a result, the possibility can be reduced that the articles A fly out through the opening of the cardboard box C due to inertial forces.

(4-3)

With the boxing apparatus 10 according to the present embodiment, the guide/holding member 110 at least holds the articles A disposed in the uppermost layer in the cardboard box C, whose opening faces sideways, at the time of the posture change operation of the cardboard box C by the holding and posture changing mechanism 50.

With this configuration, the possibility can be reduced that the articles A in the uppermost layer, which are located further from the rotation shaft 59*a* of the rotation portion 59 and are most prone to inertial forces, fly out through the opening when changing the posture of the cardboard box C by moving the upper edge of the cardboard box C, whose opening faces sideways, downward.

(4-4)

With the boxing apparatus 10 according to the present embodiment, the guide/holding member 110 functions as a guide member that enters into the cardboard box C through the opening and uses the upper guide face 110*a* thereof to guide the movement of the articles A when the push-in mechanism 40 pushes the articles A into the cardboard box C whose opening faces sideways.

With this configuration, the guide member that guides the movement of the articles A when pushing the articles A into the cardboard box C also functions as the holding member, thereby eliminating the need for a separate, dedicated holding member and making it possible to lessen the increases in apparatus costs.

(4-5)

With the boxing apparatus 10 according to the present embodiment, the guide/holding member 110 holds at least a portion of the articles A stored in the cardboard box C and further pushes the articles A into the cardboard box C at the time of the posture change operation of the cardboard box C by the holding and posture changing mechanism 50.

In this case, the guide/holding member 110 does not merely hold the articles A, but also pushes the articles A into the cardboard box C, thereby making it remarkably easier to reduce the possibility that the articles A fly out through the opening.

(4-6)

With the boxing apparatus 10 according to the present embodiment, the guide/holding member 110 holds at least a portion of the articles A stored in the cardboard box C during at least an initial stage of the posture change operation of the cardboard box C by the holding and posture changing mechanism 50.

With this configuration, the possibility that the articles A fly out can be reduced by the guide/holding member 110 during the initial stage of the posture change operation of the cardboard box C, at which gravity is less likely to act as a force to suppress the articles A from flying out through the opening.

(4-7)

With the boxing apparatus 10 according to the present embodiment, the guide/holding member 110 holds the articles A stored in the cardboard box C while moving in the first direction (backward). The magnitude of the movement speed of the guide/holding member 110 when holding the articles A stored in the cardboard box C is larger than the magnitude of the first direction component of the movement speed of the articles A to be held by the guide/holding member 110.

With this configuration, the guide/holding member 110 moves faster than the articles A to be held by the guide/holding member 110. As a result, it is more likely that the articles A will be held reliably by the guide/holding member 110, thereby making it easier to reduce the possibility that the articles A fly out through the opening.

(4-8)

With the boxing apparatus 10 according to the present embodiment, the articles A are bag products made from flexible packing material.

With this configuration, the articles A are bag products made from flexible packing material and the shape thereof easily changes. As such, space is more likely to form between the bag products and phenomena such as a portion of the bag products protruding through the opening of the cardboard box C are more likely to occur. However, the guide/holding member 110 can easily reduce the possibility that the articles A fly out through the opening even when the articles A to be boxed are bag products.

(5) Modification Examples

Next, modifications examples will be described. Note that the modification examples may be appropriately combined, provided that they do not conflict with each other.

(5-1) Modification Example A

In the embodiment described above, the guide/holding member 110 that functions as the guide member also functions as the holding member. However, the present invention is not limited thereto. For example, a configuration is possible in which the guide/holding member 110 only functions as the guide member.

In such a case, for example, in place of the guide/holding member 110, the push-in member 41 may be moved backward so as to hold at least a portion of the articles A stored in the cardboard box C at the time of the posture change operation of the cardboard box C by the holding and posture changing mechanism 50.

In this case, a configuration is possible in which the push-in member 41 does not merely hold a portion of the articles A stored in the cardboard box C (the articles A disposed in the uppermost layer in the cardboard box C whose opening faces sideways), but rather holds all of the articles A stored in the cardboard box C. Additionally, in, for example, a case in which three layers or more of the articles A are stored in the cardboard box C, whose opening faces sideways, a configuration is possible in which the push-in member 41 holds the articles A disposed in the uppermost layer in the cardboard box C, whose opening faces sideways, and also holds the articles A disposed in the layers below the uppermost layer.

Moreover, for example, a configuration is possible in which a dedicated holding member, which holds at least a portion of the articles A stored in the cardboard box C at the time of the posture change operation of the cardboard box C by the holding and posture changing mechanism 50, is provided in place of the guide/holding member 110. In this case, a configuration is possible in which the dedicated holding member holds a portion of the articles A stored in the cardboard box C, or holds all of the articles A stored in the cardboard box C. Additionally, in this case, a configuration is possible in which the dedicated holding member does not only hold the articles A disposed in the uppermost layer in the cardboard box C, whose opening faces sideways, but also holds the articles A disposed in the layers below the uppermost layer.

The holding member need not hold the articles A stored in the cardboard box C while moving backward. For example, a configuration is possible in which the holding member holds the articles A stored in the cardboard box C while moving downward and backward. Additionally, a configuration is possible in which the holding member moves in a curve manner instead of moving in a linear manner.

(5-2) Modification Example B

In the embodiment described above, the box in which the articles are stored is a cardboard box, but the box is not limited to a cardboard box. The boxing apparatus according to the present invention can be applied to objects other than cardboard boxes that have openings.

(5-3) Modification Example C

In the embodiment described above, the boxing apparatus 10 is formed integrally with the box making apparatus 2 and the box closing apparatus 3 to configure the box making and boxing system 1, but the present invention is not limited to this configuration. A configuration is possible in which the boxing apparatus 10 is provided as an independent apparatus and not integrated with the box making apparatus 2 and the box closing apparatus 3.

INDUSTRIAL APPLICABILITY

Certain implementations are useful because they can be broadly applied to a boxing apparatus that pushes a plurality of articles from the side into a box whose opening faces sideways, and then change the posture of the box by rotating the box so that the opening faces upward.

The invention claimed is:

1. A boxing apparatus, comprising:

a push-in mechanism that laterally pushes a plurality of articles into a box, whose opening faces sideways, from a side of the box;

a holding and posture changing mechanism that holds the box whose opening faces sideways, and changes a posture of the box, after the articles have been pushed into the box by the push-in mechanism, by rotating the box whose opening faces sideways, such that the opening faces upward;

a holding member;

a holding member driving mechanism configured to move the holding member; and a controller configured to control operations of the push-in mechanism, the holding and posture changing mechanism, and the holding member driving mechanism, the controller being configured to control the operation of the holding member driving mechanism so that the holding member moves in a first direction approaching the box and the holding member holds at least a portion of the articles stored in the box when the controller controls the operation of the holding and posture changing mechanism to rotate the box in which the articles are filled and whose opening faces sideways, such that the opening faces upward.

2. The boxing apparatus according to claim 1, wherein the holding member holds an upstream side in a movement direction of the articles when the articles stored in the box are moved due to movement of the box at the time of a posture change operation of the box by the holding and posture changing mechanism.

3. The boxing apparatus according to claim 1, wherein the holding member holds at least the articles disposed in an uppermost layer in the box, whose opening faces sideways, at the time of a posture change operation of the box by the holding and posture changing mechanism.

4. The boxing apparatus according to claim 1, wherein the holding member functions as a guide member that enters into the box through the opening and uses an upper guide face thereof to guide movement of the articles when the push-in mechanism pushes the articles into the box whose opening faces sideways.

5. The boxing apparatus according to claim 1, wherein the holding member holds at least a portion of the articles stored in the box and further pushes the articles into the box at the time of a posture change operation of the box by the holding and posture changing mechanism.

6. The boxing apparatus according to claim 1, wherein the holding member holds at least a portion of the articles stored in the box during at least an initial stage of a posture change operation of the box by the holding and posture changing mechanism.

7. The boxing apparatus according to claim 1, wherein the holding member holds the articles stored in the box while moving in the first direction at a holding member movement speed;

the articles are being held by the holding member while moving in the first direction at an articles movement speed; and a magnitude of the holding member movement speed is larger than a magnitude of a component in the first direction of the articles movement speed.

8. The boxing apparatus according to claim 1, wherein the articles are bag products made from a flexible packing material.

* * * * *